US008272642B2

(12) United States Patent
Kikuchihara et al.

(10) Patent No.: US 8,272,642 B2
(45) Date of Patent: Sep. 25, 2012

(54) WARPAGE LEVELING UNIT, WARPAGE LEVELING DEVICE, IMAGE FORMING APPARATUS AND WARPAGE LEVELING PROCESSING PROGRAM

(75) Inventors: Katsunori Kikuchihara, Kanagawa (JP); Takashi Kawabata, Kanagawa (JP); Masaaki Takahashi, Kanagawa (JP); Nobuo Hyakutake, Kanagawa (JP); Taku Fukuhara, Kanagawa (JP)

(73) Assignee: Fuji Xerox Co. Ltd., Tokyo (JP)

( * ) Notice: Subject to any disclaimer, the term of this patent is extended or adjusted under 35 U.S.C. 154(b) by 51 days.

(21) Appl. No.: 12/361,110

(22) Filed: Jan. 28, 2009

(65) Prior Publication Data

US 2010/0052242 A1 Mar. 4, 2010

(30) Foreign Application Priority Data

Sep. 4, 2008 (JP) ..... P2008-227306

(51) Int. Cl.
*B65H 5/02* (2006.01)

(52) U.S. Cl. ..... 271/275; 399/162; 399/316

(58) Field of Classification Search ..... 271/18.3, 271/275; 399/162, 316, 406, 350, 351; 347/104; 198/837, 840, 841
See application file for complete search history.

(56) References Cited

U.S. PATENT DOCUMENTS

| | | | | |
|---|---|---|---|---|
| 4,781,091 | A * | 11/1988 | Nakaya | 83/107 |
| 5,452,060 | A * | 9/1995 | Sakanobe | 399/164 |
| 2007/0029171 | A1 * | 2/2007 | Nemedi | 198/841 |
| 2007/0048049 | A1 * | 3/2007 | Pozniakas et al. | 399/350 |

FOREIGN PATENT DOCUMENTS

| | | |
|---|---|---|
| JP | 07-175346 | 7/1995 |
| JP | 07-306601 | 11/1995 |
| JP | 2000-187426 | 7/2000 |
| JP | 2001-129837 | 5/2001 |
| JP | 2002-156835 | 5/2002 |
| JP | 2003-043764 | 2/2003 |
| JP | 2007-178750 | 7/2007 |

* cited by examiner

*Primary Examiner* — Jeremy R Severson
(74) *Attorney, Agent, or Firm* — Sughrue Mion, PLLC

(57) ABSTRACT

A warpage leveling unit includes a surface roughening member that is provided to oppose to a side end portion of an image carrier which has an endless-belt-shape, is entrained around a plurality of rollers, and carries an image on a surface of the image carrier, wherein the surface roughening member comes into contact with a surface of the side end portion which is warped.

2 Claims, 28 Drawing Sheets

WARPAGE LEVELING UNIT, WARPAGE LEVELING DEVICE, IMAGE FORMING APPARATUS AND WARPAGE LEVELING PROCESSING PROGRAM

CROSS-REFERENCE TO RELATED APPLICATION

This application is based on and claims priority under 35 USC 119 form Japanese Patent Application No. 2008-227306 filed Sep. 4, 2008.

BACKGROUND

Technical Field

The present invention relates to a warpage leveling unit, warpage leveling device, image forming apparatus and warpage leveling processing program.

SUMMARY

According to an aspect of invention, a warpage leveling unit includes a surface roughening member that is provided to oppose to a side end portion of an image carrier which has an endless-belt-shape, is entrained around plural rollers, and carries an image on a surface of the image carrier, wherein the surface roughening member comes into contact with a surface of the side end portion which is warped.

BRIEF DESCRIPTION OF THE DRAWINGS

Exemplary embodiments of the invention will be described in detail based on the following figures wherein.

DETAILED DESCRIPTION

Figure 1A:
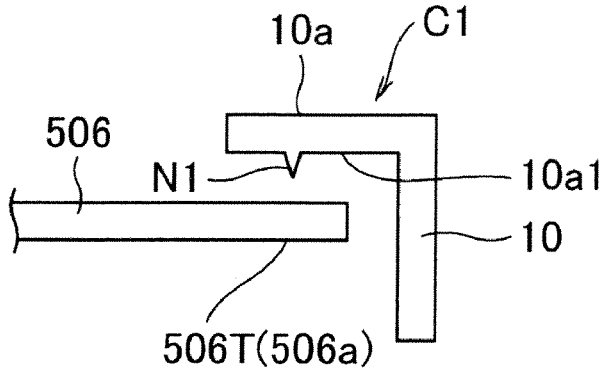
FIG. 1A is a schematic illustration showing an example of the arrangement of the warpage leveling unit C1 of the first exemplary embodiments.

Referring to the drawings, an exemplary embodiment, which is an example of the present invention, will be explained in detail as follows. In this case, like reference marks are used to indicate like members in the accompanying drawings and the duplicated explanations are omitted here. In this connection, since the best mode to be carried out by the present invention is explained here, the present invention is not necessarily restricted by the exemplary embodiment concerned.

First Embodiment

Referring to FIGS. 1A to 6, explanations will be made into a warpage leveling unit C1 related to the first exemplary embodiment of the present invention.

As shown in FIG. 1A, the warpage leveling unit C1 is composed in such a manner that the needle member N1, which is a surface roughening member, is provided on the reverse side 10*a*1 of the horizontal portion 10*a* of a warpage leveling body 10, the shape of which is formed into a reverse-L-shape.

A shape and material of the needle member N1 are not particularly restricted. For example, the needle member N1 can be a minute metallic needle such as a needle for a record.

The leveling tool C1 is arranged so that the needle member N1 can be opposed to a surface side of the side end portion 506T of the endless-belt-shaped image carrier 506 mounted on an electrostatic copier or a printer which is an image forming apparatus. In this connection, although the right end side of the endless-belt-shaped image carrier 506 is shown in FIG. 1A, the structure on the left end side is the same as that on the right end side.

In this connection, the side end portion 506T is defined as a portion of a predetermined width directed to the inside from an edge of the endless-belt-shaped image carrier 506.

Although the endless-belt-shaped image carrier 506 is not particularly restricted, it is composed as a semi-conductive belt having plural polyimide resin layers having at least one layer containing conductive material.

Polyimide resin is a thermo-setting resin manufactured by condensation polymerization of acid anhydride and diamine. The heat resistance property and the mechanical strength property of polyimide are excellent. Therefore, polyimide is utilized as a highly reliable resin in the fields of electrical engineering and electronics and space development.

Figure 2A:
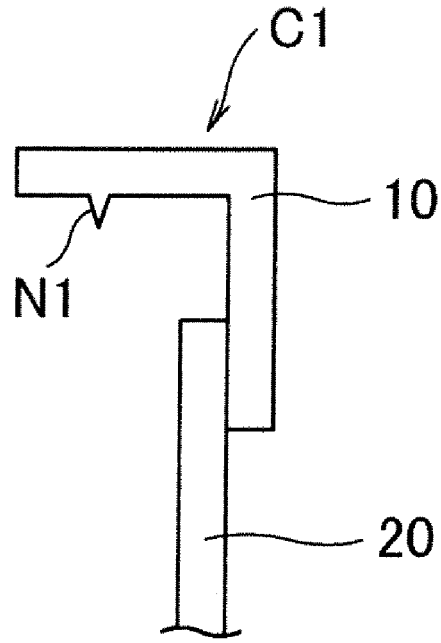
FIG. 2A is a side view showing a manner of mounting the warpage leveling unit C1 of the first exemplary embodiment.
Figure 2B:
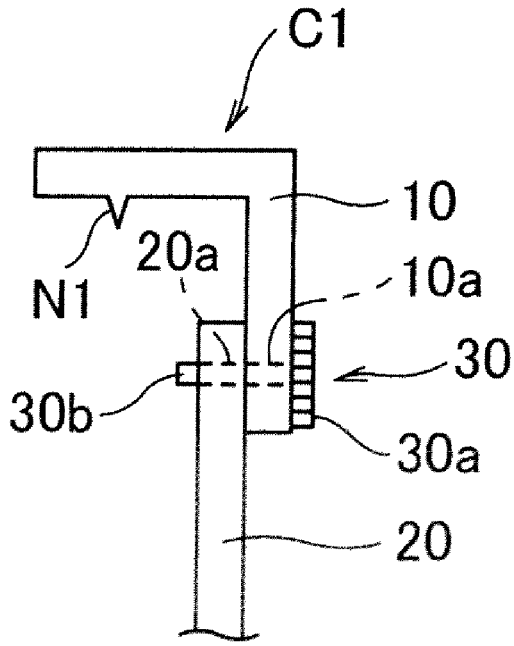
FIG. 2B is a side view showing a manner of mounting the warpage leveling unit C1 of the first exemplary embodiment.

A method of mounting the leveling tool C1 is not particularly restricted. For example it is possible to consider one case as shown in FIG. 2A in which the leveling tool C1 is fixed to the intermediate transfer body frame 20, which is provided in the image forming apparatus, by means of welding. It is also possible to consider another case as shown in FIG. 2B in which the screw holes 20*a*, 10*a* are formed in the intermediate transfer body frame 20 and the leveling tool C1, respectively. Then the screw portion 30*b* is screwed into the screw holes 20*a*, 10*a* by using the fixing member 30 having the dial 30*a* that is manually operated so that the leveling tool C1 can be detachably fixed to the intermediate transfer body frame 20.

Especially, in the case where the leveling tool C1 is detachably fixed to the intermediate transfer body frame 20 by using the fixing member 30 as shown in FIG. 2B, it is possible for a worker executing the maintenance work of the endless-belt-shaped image carrier 506 to attach and detach the leveling tool C1 when necessary. Therefore, the convenience of the maintenance work can be enhanced.

In this connection, the fixing member is not limited to the screw type. It is possible to use a well known type fixing member in which the leveling tool C1 is pinched by a spring force with respect to the intermediate transfer body frame 20.

Figure 30A:
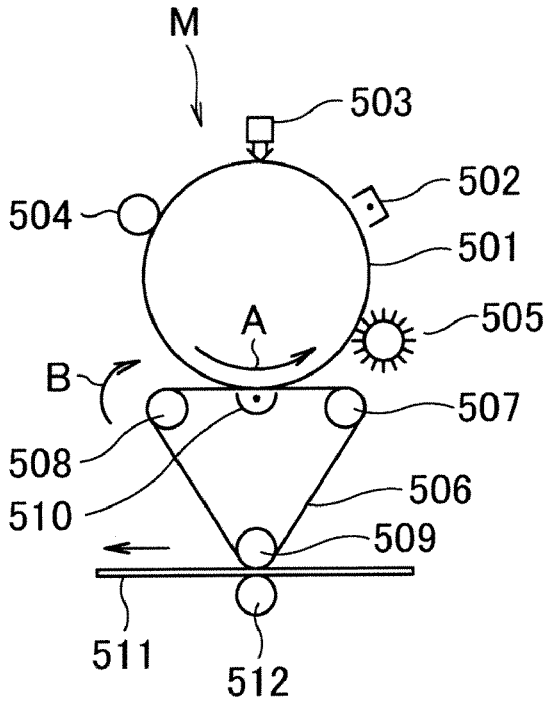
FIG. 30A is an arrangement view showing an outline of the arrangement of the commonly used intermediate transfer unit M.
Figure 30B:
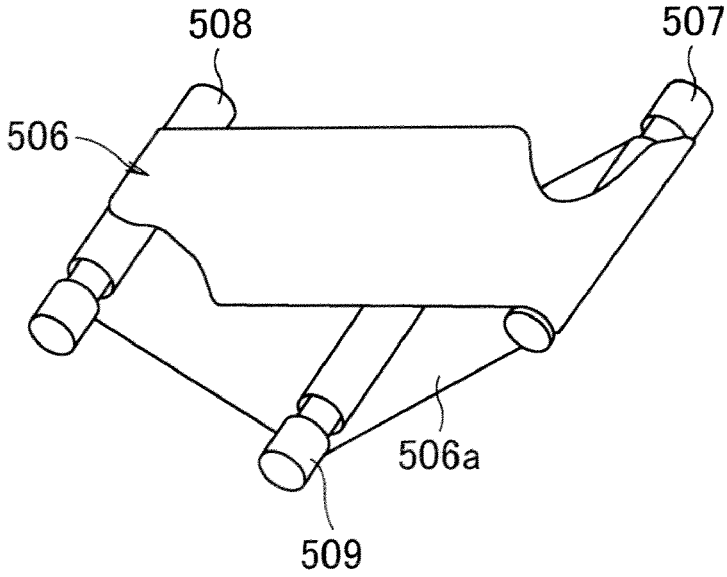
FIG. 30B is an arrangement view showing an outline of the arrangement of the commonly used intermediate transfer unit M.

Referring again to FIG. 1A, an action of the leveling tool C1 will be described below. However, before the description of the action of the leveling tool C1, referring to FIGS. 30 to 32, the intermediate transfer unit M, which is an object to be compared with, will be briefly explained as follows.

First of all, a surface of the photoconductor drum 501 rotating in the arrowed direction A is uniformly charged by the charger 502.

Next, an electrostatic latent image corresponding to an image obtained by an image reading unit not shown is formed on the photoconductor drum 501 by the optical system 503 and then developed into a toner image by the developing unit 504.

This toner image is electrostatically transferred onto an endless-belt-shaped image carrier by the electrostatic transfer unit 250 and further transferred onto the sheet of recording paper 511 between the conveyance roller 509 and the pushing roller 122.

In this connection, in the case where the contamination (for example reference numeral 600 shown in FIG. 31) attaches onto surfaces of the conveyance rollers 507, 508, 509 or in the case where the flaw (for example, reference numeral 601 shown in FIG. 31) is caused on the surface when foreign objects are mixed into, the flaw (for example, reference mark K shown in FIG. 31) is caused on the reverse side 506*a* (shown in FIGS. 30A and 30B) of the endless-belt-shaped image carrier 506 by the contamination 600 and the flaw 601.

Figure 31:
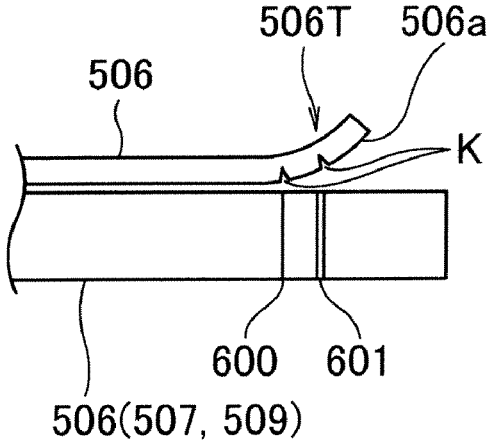
FIG. 31 is a schematic illustration showing a phenomenon of warpage of the side end portion 506T of the endless-belt-shaped image carrier 506.
Figure 32:
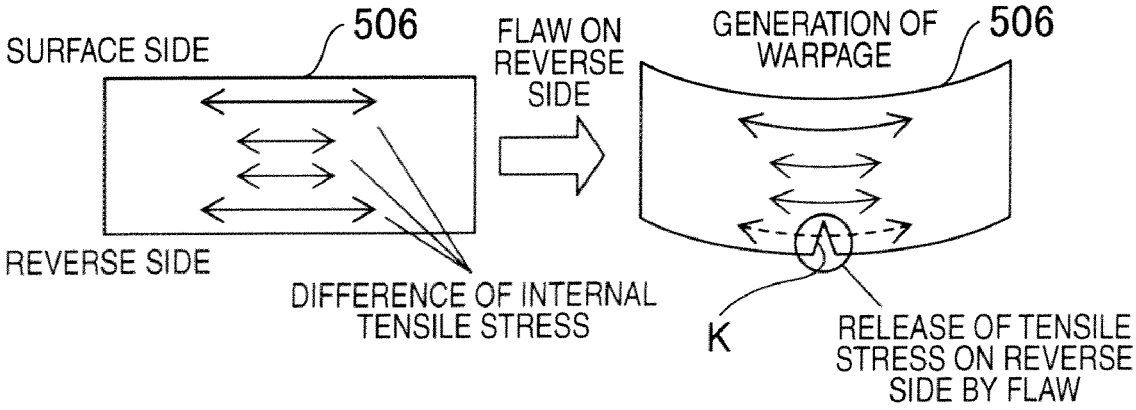
FIG. 32 is a schematic illustration showing the principle of a phenomenon of warpage of the side end portion 506T of the endless-belt-shaped image carrier 506.

It is known by experience that the contamination 600 and the flaw 601 tend to be generated at end portions of the conveyance rollers 507, 508, 509. Accordingly, the flaw K on the reverse side 506*a* of the endless-belt-shaped image carrier 506 also tends to be generated in the side end portion 506T of the endless-belt-shaped image carrier 506 as shown in FIG. 31.

When the flaw K is generated on the reverse side 506*a* of the side end portion 506T of the endless-belt-shaped image carrier 506, the side end portion 506T is warped.

When the side end portion 506T of the endless-belt-shaped image carrier 506 is warped as described above, at the time of attaching and detaching the drum unit having the photoconductor drum 501 and also at the time of attaching and detaching the intermediate transfer belt unit having the endless-belt-shaped image carrier 506, the side end portion 506T interferes with the peripheral components and the endless-belt-shaped image carrier 506 itself may be damaged.

Further, there is a possibility that the endless-belt-shaped image carrier 506 can not be accurately detected by a belt edge sensor or a home position sensor.

In the case where metallic rollers are used for the rollers to support the endless-belt-shaped image carrier 506, since the hardness of the metallic rollers is high, the inside of the belt tends to be damaged by foreign objects.

Figure 1B:
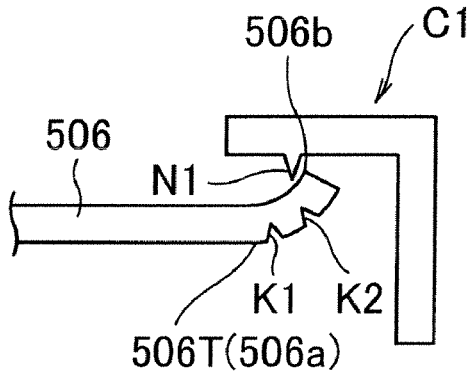
FIG. 1B is a schematic illustration showing an example of the arrangement of the warpage leveling unit C1 of the first exemplary embodiment.

In the case where the contamination (for example, reference numeral 600 shown in FIG. 31) is attached onto the surface of the conveyance rollers 507, 508, 509 (shown in FIGS. 30A and 30B) to support the endless-belt-shaped image carrier 506 or in the case where the flaw (for example, reference numeral 601 shown in FIG. 31) is generated on the surface by the mixed foreign objects, the flaw (K1, K2) is generated on the reverse side 506*a* of the side end portion 506T of the endless-belt-shaped image carrier 506 by the contamination 600 and the flaw 601. Accordingly, the side end portion 506T of the endless-belt-shaped image carrier 506 is warped upward as shown in FIG. 1B.

This phenomenon of warping is generated when the internal tensile stress is released by the generation of the flaw K (K1, K2) because the internal stress in the neighborhoods of the surface side and the reverse side, which is generated at the time of manufacturing the endless-belt-shaped image carrier 506, is different from the internal stress, that is, because a difference in the internal tensile stress is generated.

Figure 1C:
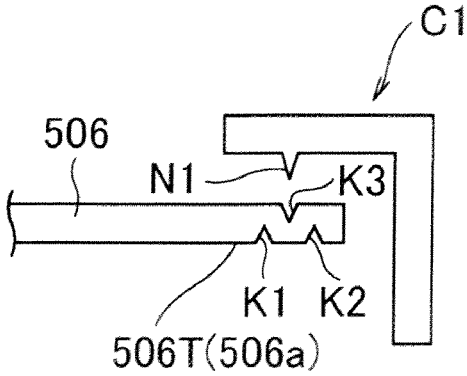
FIG. 1C is a schematic illustration showing an example of the arrangement of the warpage leveling unit C1 of the first exemplary embodiment.

When the surface 506*b* of the warped portion of the side end portion 506T of the endless-belt-shaped image carrier 506 comes into contact with a tip of the needle member N1 of the leveling tool C1, the groove K3 is formed on the surface 506*b* as shown in FIG. 1C.

By this groove K3, the internal stress on the surface 506*b* side of the endless-belt-shaped image carrier 506 is released and a warpage of the side end portion 506T of the endless-belt-shaped image carrier 506 is leveled as shown in FIG. 1C.

Due to the foregoing, when the maintenance work such as a replacement of the endless-belt-shaped image carrier 506 is executed, the warped portion of the side end portion 506T of the endless-belt-shaped image carrier 506 does not interfere with other members.

Figure 8:
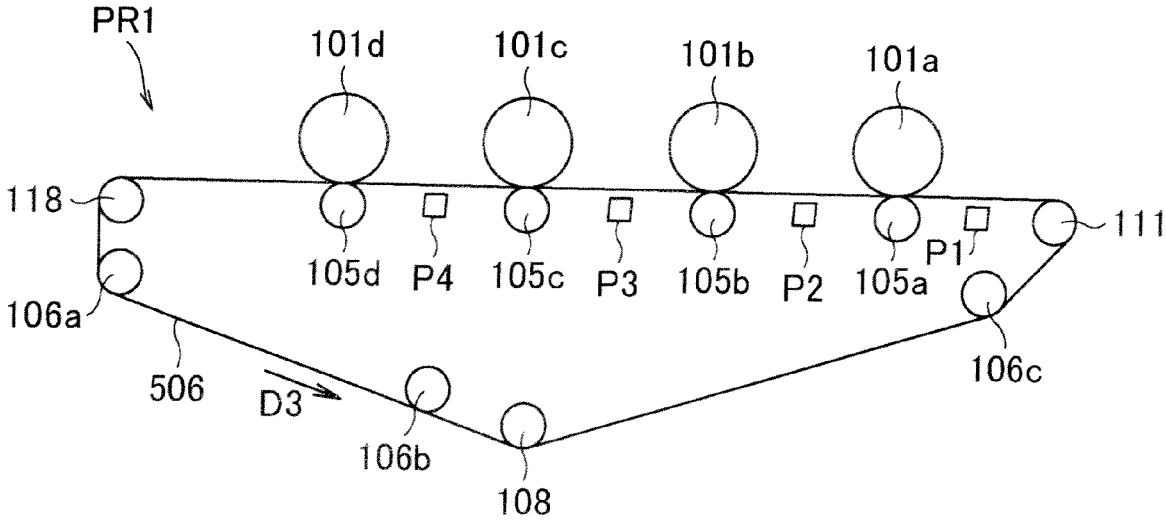
FIG. 8 is a schematic illustration showing a mounting position of mounting the warpage leveling device M1 in the image forming apparatus PR1.
Figure 33:
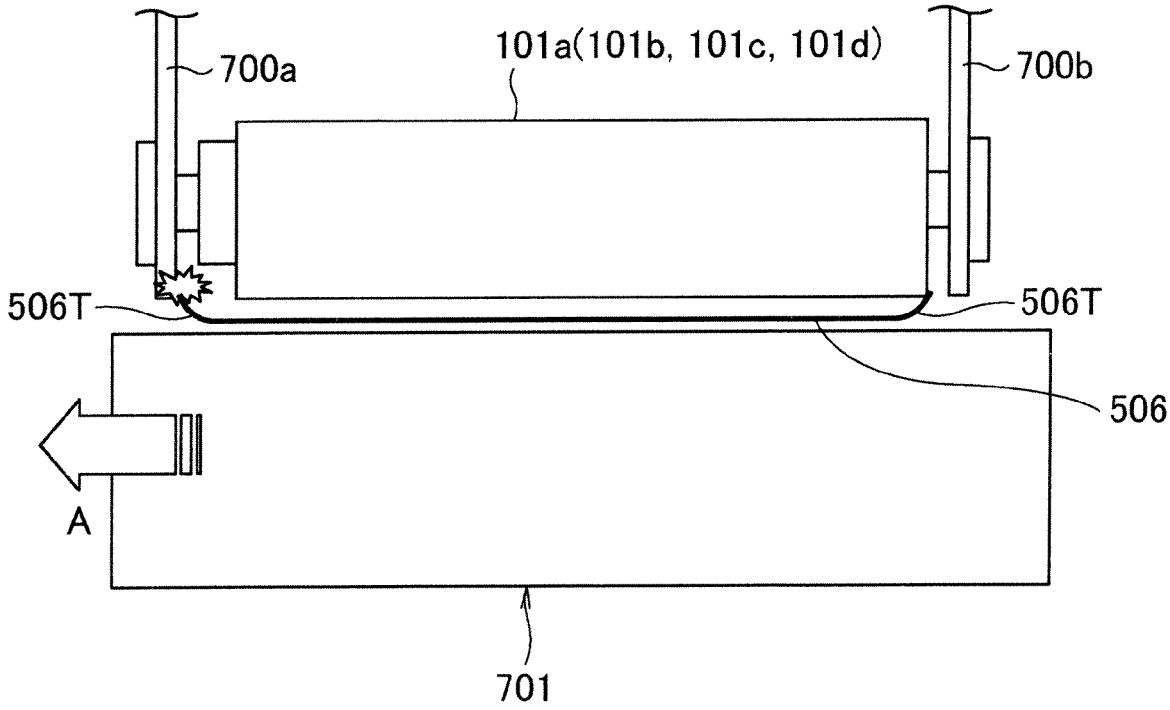
FIG. 33 is a schematic illustration showing a state in which problems are caused by a warpage of the endless-belt-shaped image carrier 506.

Referring to FIGS. 8 and 33, explanations will be made into a state in which the endless-belt-shaped image carrier 506 and the photoconductor drums 101*a* to 101*d*, which are other members, interfere with each other.

In FIG. 8, the endless-belt-shaped image carrier 506 is entrained around the following rollers and rotated in the direction of the arrow D3. The rollers are: a drive roller 111 for driving the endless-belt-shaped image carrier 506; tension rollers 106*a* to 106*c* for giving tension to the endless-belt-shaped image carrier 506; a steering roller 118 for controlling a position of the belt; primary transfer rollers 105*a* to 105*d*; and a backup roller 108 for supporting the belt in the transfer portion.

Four drum-shaped photoconductors 101*a* to 101*d* are provided being opposed to the primary transfer rollers 105*a* to 105*d*.

In this case, as shown in FIG. 33, the photoconductor drums 101*a* to 101*d* are pivotally supported by the frames 700*a*, 700*b*.

The endless-belt-shaped image carrier 506, which is separate from the photoconductor drums 101*a* to 101*d*, is drawn out in the arrowed direction A together with the intermediate transfer module 701 including the primary transfer rollers 105*a* to 105*d*.

In a state in which the intermediate transfer module 701 has been drawn out, the endless-belt-shaped image carrier 506 is replaced and various maintenance work is executed.

In this connection, as explained in FIGS. 1A to 1C, when the side end portion 506T of the endless-belt-shaped image carrier 506 is warped, as shown in FIG. 33, at the time of drawing out the intermediate transfer module 701 in the direction A, the warped side end portion 506T comes into contact and interferes with an end portion of the frame 700*a* and it becomes impossible to properly draw out the endless-belt-shaped image carrier 506 and further there is a possibility that the endless-belt-shaped image carrier 506 is broken.

On the other hand, in the case where the leveling tool C1 of the present exemplary embodiment is used, since a warpage generated in the side end portion 506T of the endless-belt-shaped image carrier 506 is leveled, the frame 700*a* and the side end portion 506T of the endless-belt-shaped image carrier 506 do not interfere with each other which is not like the circumstances shown in FIG. 33. Accordingly, the intermediate transfer module 701 can be smoothly drawn out and the endless-belt-shaped image carrier 506 can be replaced and various maintenance works can be executed.

Figure 3:
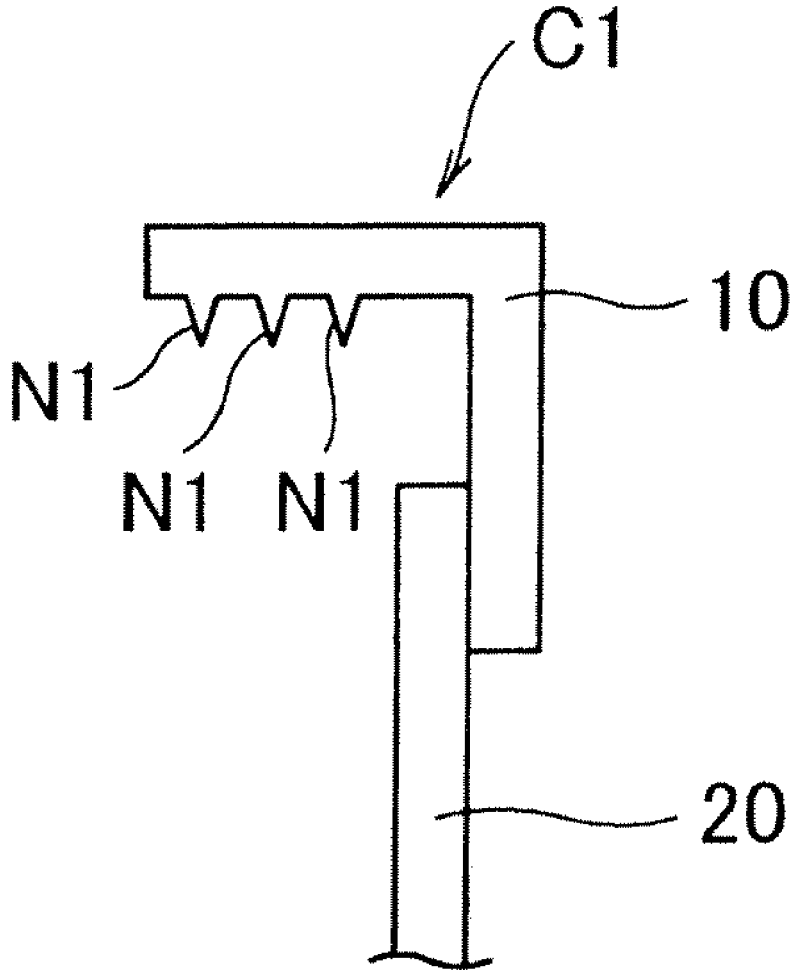
FIG. 3 is a side view showing another example of the arrangement of the warpage leveling unit C1 of the first exemplary embodiment.

The number of the needle members N1 provided in the leveling tool C1 is not limited to one as shown in FIGS. 1A to 1C but two or more needle members N1 may be provided as shown in FIG. 3. Due to the foregoing, grooves can be more positively formed on the surface 506*b* side of the endless-belt-shaped image carrier 506.

Figure 4:
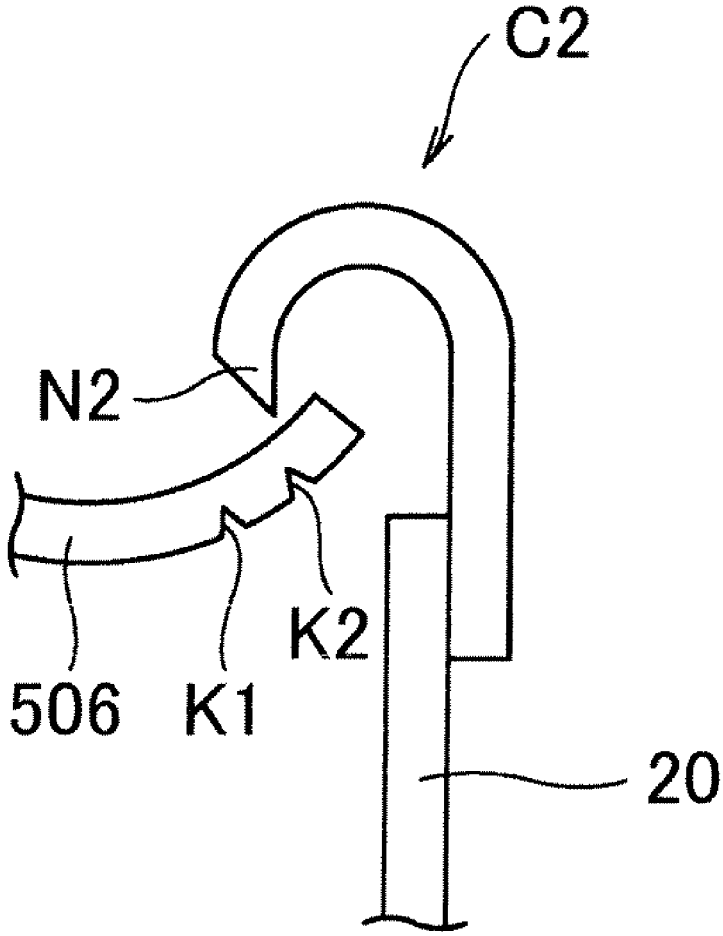
FIG. 4 is a side view showing an example of the arrangement of the warpage leveling unit C2 of the first exemplary embodiment.

As shown in FIG. 4, the leveling tool C2 may be used which is formed in such a manner that the horizontal portion 10*a* of the leveling tool C1 is curved into a hook-shape and the needle member N2 is formed at the tip by a predetermined angle.

Due to the foregoing, the needle member N2 is provided on a normal line at any position of the side end portion 506T. Therefore, it is difficult for the needle member N2 to slide on a surface of the endless-belt-shaped image carrier 506. Accordingly, it becomes possible to more positively form a groove on the image carrier 506*b* side and a warpage can be more positively leveled.

Figure 5:
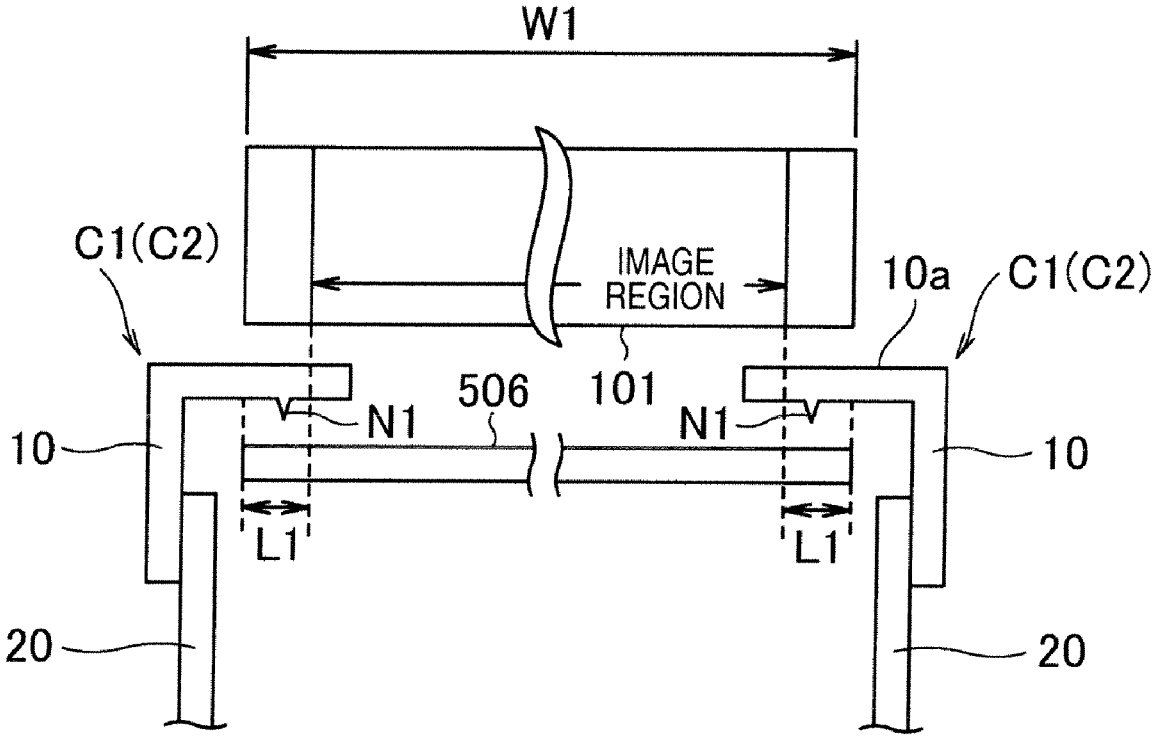
FIG. 5 is a schematic illustration showing a mounting position of mounting the warpage leveling unit C1 (C2)
Figure 6A:
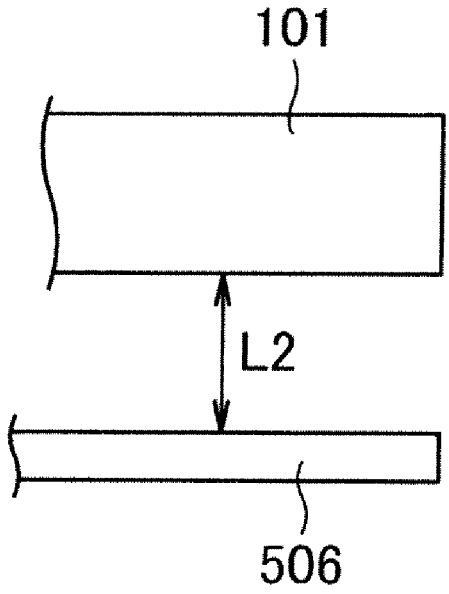
FIG. 6A is a schematic illustration showing a mounting position of mounting the warpage leveling unit C1 (C2)
Figure 6B:
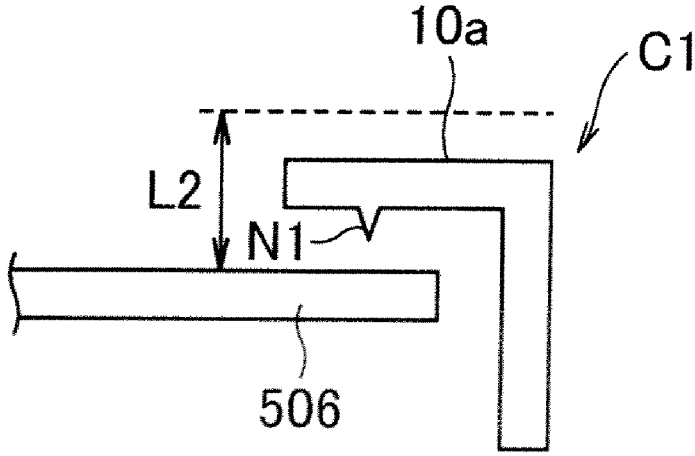
FIG. 6B is a schematic illustration showing a mounting position of mounting the warpage leveling unit C1 (C2)

Next, referring to FIGS. 5 and 6, a position at which the leveling tool C1 (C2) is attached.

In the case where the width of the photoconductor drum 101 of the image forming apparatus is W1 and the width of the image forming region for carrying an image on the photoconductor drum 101 concerned is G1, the leveling tool C1 (C2) may be mounted so that the needle member N1 (N2) of the leveling tool C1 (C2) can be located in the range of L1=(W1-G1)/2 in the endless-belt-shaped image carrier 506.

Due to the foregoing, a generation of a defective image can be reduced which is caused by the influence of the warpage generated by the flaw K (K1, K2) caused in the endless-belt-shaped image carrier 506 in the image region.

While the image forming processing is being carried out, the photoconductor drum 101 and the endless-belt-shaped image carrier 506 are tightly contacted with each other. However, at the time of executing the maintenance work of the photoconductor drum 101 and the endless-belt-shaped image carrier 506, the photoconductor drum 101 and the endless-belt-shaped image carrier 506 are separated from each other by the distance L2, as shown in FIG. 6A.

Concerning the position in the height direction at which the leveling tool C1 (C2) is mounted, the distance may not be more than L2.

Due to the foregoing, before the photoconductor drum 101, the side end portion 506T of the endless-belt-shaped image carrier 506 and the peripheral members are contacted with each other, a warpage is leveled and the maintenance work can be smoothly executed.

A position in the circumferential direction of the leveling tool C1 (C2) may be arranged at a position where the side end portion is greatly warped at the time of belt running and the belt position is stabilized. Specifically, the position in the circumferential direction of the leveling tool C1 (C2) may be arranged at a central position between the pressure contact positions of the plural photoconductor drums 101 and the primary transfer members.

Alternatively, the position in the circumferential direction of the leveling tool C1 (C2) may be arranged close to the home position sensor or the edge sensor.

As described above, the needle member N1, which is one form of the surface roughening member of the present exemplary embodiment, has an action of forming a groove on the endless-belt-shaped image carrier 506 or an action of shaving a surface of the endless-belt-shaped image carrier 506.

Second Embodiment

Figure 7:
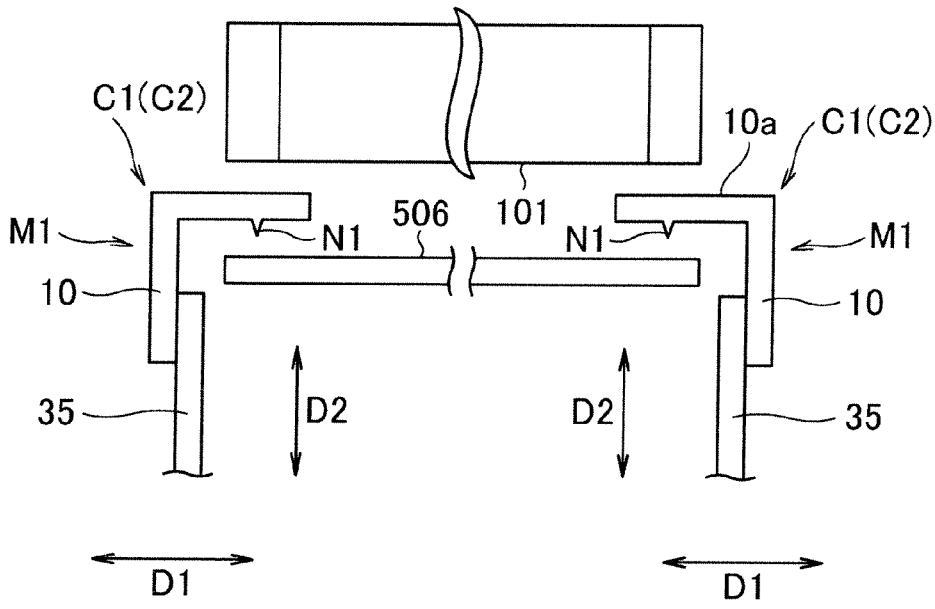
FIG. 7 is a schematic illustration showing an example of the arrangement of the warpage leveling device M1 of the second exemplary embodiment.

Referring to FIGS. 7 and 8, the warpage leveling device M1 of the second exemplary embodiment of the present invention will be explained below.

In this connection, concerning the same structure as that of the leveling tool C1 (C2) of the first exemplary embodiment, like reference marks are used and the explanations are omitted here.

In this exemplary embodiment, the leveling tool C1 (C2) is mounted on the actuator 30 capable of moving in the horizontal direction D1 and the vertical direction D2.

A driving system of the actuator 35 is not particularly restricted, however, for example, it is possible to use a solenoid or an air cylinder.

When the actuator 35 is driven, the needle member N1 (N2) of the leveling tool C1 (C2) is moved to a predetermined position.

A driving operation of the actuator 30 is not particularly restricted, however, an operator may manually operate the actuator 35 through a user interface. Alternatively, a positional sensor may be provided at a predetermined position and the needle member N1 (N2) may be automatically moved to a predetermined position through a control unit such as a microcomputer.

In the image forming apparatus PR1, a position at which the leveling tool M1 is arranged is not particularly restricted. However, for example, the leveling tool M1 may be arranged at the positions P1 to P4 shown in FIG. 8.

In FIG. 8, the endless-belt-shaped image carrier 506 is entrained around the following rollers and rotated in the direction of the arrow D3. The rollers are: a drive roller 111 for driving the endless-belt-shaped image carrier 506; tension rollers 106*a* to 106*c* for giving tension to the endless-belt-shaped image carrier 506; a steering roller 118 for controlling a position of the belt; primary transfer rollers 105*a* to 105*d*; and a backup roller 108 for supporting the belt in the transfer portion.

Four drum-shaped photoconductors 101*a* to 101*d* are provided being opposed to the primary transfer rollers 105*a* to 105*d*.

In the example shown in FIG. 8, the warpage leveling devices M1 are provided at all positions or at any positions including: a position between the drive roller 111 and the primary transfer roller 105*a* (position P1); a position between the primary transfer rollers 105*a* and 105*b* (position P2); a position between the primary transfer rollers 105*b* and 105*c* (position P3); and a position between the primary transfer rollers 105*c* and 105*d* (position P4).

Due to the foregoing, in the case where the side end portion 506T of the endless-belt-shaped image carrier 506 is warped, the warpage can be positively leveled and the maintenance work can be smoothly executed.

In this connection, the leveling tools C1 (C2) of the first exemplary embodiment may be fixed to or detachably mounted at the positions P1 to P4 described above.

The endless-belt-shaped image carrier 506 is entrained around plural rollers (the drive roller 111, the rollers 106*a* to 106*c* and so forth) so that a reverse side of the endless-belt-shaped image carrier 506 can be contacted with the rollers. An image is held on a surface side of the endless-belt-shaped image carrier 506 and the warpage leveling device M1, which is a surface roughening member, is contacted with the surface side of the endless-belt-shaped image carrier 506.

Third Embodiment

Referring to FIGS. 9 to 12 explanations will be made into an image forming apparatus PR3 of the third exemplary embodiment of the present invention.

In this connection, concerning the constitution of the leveling tool C11 (C2) of the first exemplary embodiment and also concerning the leveling device M1 of the second exemplary embodiment, the same reference marks are used and the detailed explanations are omitted here.

In the tandem type printer which is an image forming apparatus PR3, the endless-belt-shaped image carrier 506 is entrained around the drive roller 111 for driving the endless-belt-shaped image carrier 506, the tension rollers 106*a* to 106*c*, the steering roller 118, the primary transfer rollers 105*a* to 105*d* and the backup roller 108. The endless-belt-shaped image carrier 506 is rotated in the arrowed direction D3.

Four photoconductor drums 101*a* to 101*d* are arranged being opposed to the primary transfer rollers 105*a* to 105*d*.

The chargers 102*a* to 102*d* for charging electricity on the surfaces of the photoconductor drums 110*a* to 101*d*, the developing units 103*a* to 103*d* for developing an image by using toner, the cleaning units 104*a* to 104*d* and the exposure units 114*a* to 114*d* having a laser beam source are arranged round the photoconductor drums 101*a* to 101*d*.

The secondary transfer roller 109 for secondarily transferring an image, the secondary transfer belt 116 and the tension roller 106*d* are arranged being opposed to the backup roller 108. An image is secondarily transferred onto the recording medium 115 such as a sheet of printing paper. The sheet of printing paper is heated and pressurized by the fixing unit 110 arranged in the downstream so that the image can be fixed. After that, the sheet of printing paper is discharged.

The cleaning unit 117 is arranged adjacent to the drive roller 111.

At a position opposed to the drive roller 111, the grinding roller (the rotator) 200, which is a surface roughening member for roughening the surface 506*a* of the side end portion 506T of the endless-belt-shaped image carrier 506, is pivotally arranged on the rotary shaft 201.

Figure 10:
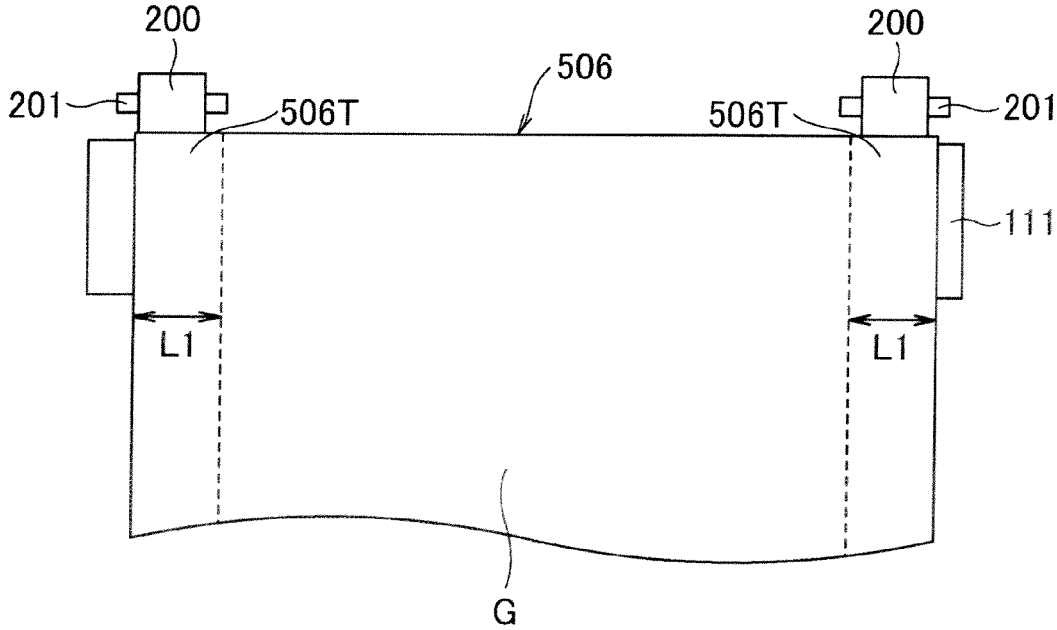
FIG. 10 is a schematic illustration showing a mounting position of mounting a grinding roller in the image forming apparatus PR3 of the third exemplar, embodiment.

As shown in FIG. 10 a pair of grinding rollers 200 are arranged so that they can be contacted with the side end portions 506T on both sides of the endless-belt-shaped image carrier 506.

A length in the axial direction of the grinding roller 200 is not particularly restricted. However, the length in the axial direction of the grinding roller 200 may be in the range of L1=(W1-G1)/2 explained in FIG. 5 with respect to the leveling tool C1 (C2) related to the first exemplary embodiment.

Due to the foregoing, a generation of a defective image can be reduced which is caused by the influence of the warpage generated by the flaw K (K1, K2) caused in the endless-belt-shaped image carrier 506 in the image region G.

A state of the surface of the grinding roller 200 is not particularly restricted. However it is possible to compose the state of the surface of the grinding roller 200 in such a manner that plural minute protrusions are formed on the surface or a grindstone is stuck onto the surface.

The grinding roller 200 can be composed in such a manner that the grinding roller 200 is contacted with the endless-belt-shaped image carrier 506 and driven while it is being trailed by the rotation of the endless-belt-shaped image carrier 506.

However, in the case where the side end portion 506T of the endless-belt-shaped image carrier 506 is warped by the flaw K (K1, K2 shown in FIGS. 1B and 1C) generated on the reverse side 506*a* and it is impossible for the grinding roller 200, which is driven when it is trailed by the rotation of the endless-belt-shaped image carrier 506, to provide a sufficiently high shaving effect of shaving the surface 506*b* of the side end portion 506T the grinding roller 200 may be driven being rotated in the opposite direction to the rotating direction D3 of the endless-belt-shaped image carrier 506.

Specifically for example, torque of a motor is transmitted to the rotary shaft 20 through a gear mechanism and the grinding roller 200 is rotated in the opposite direction to the rotating direction D3 at a predetermined rotating speed.

In this connection, the grinding roller 200 may be rotated in the same direction (D3) as that of the endless-belt-shaped image carrier 506 with a difference in the circumferential speed between the speed of the grinding roller 200 and the speed of the endless-belt-shaped image carrier 506.

In this case, referring to FIG. 11, explanations will be made into the result of an experiment in which the effect of leveling a warpage by the grinding roller 200 was verified.

Figure 11:
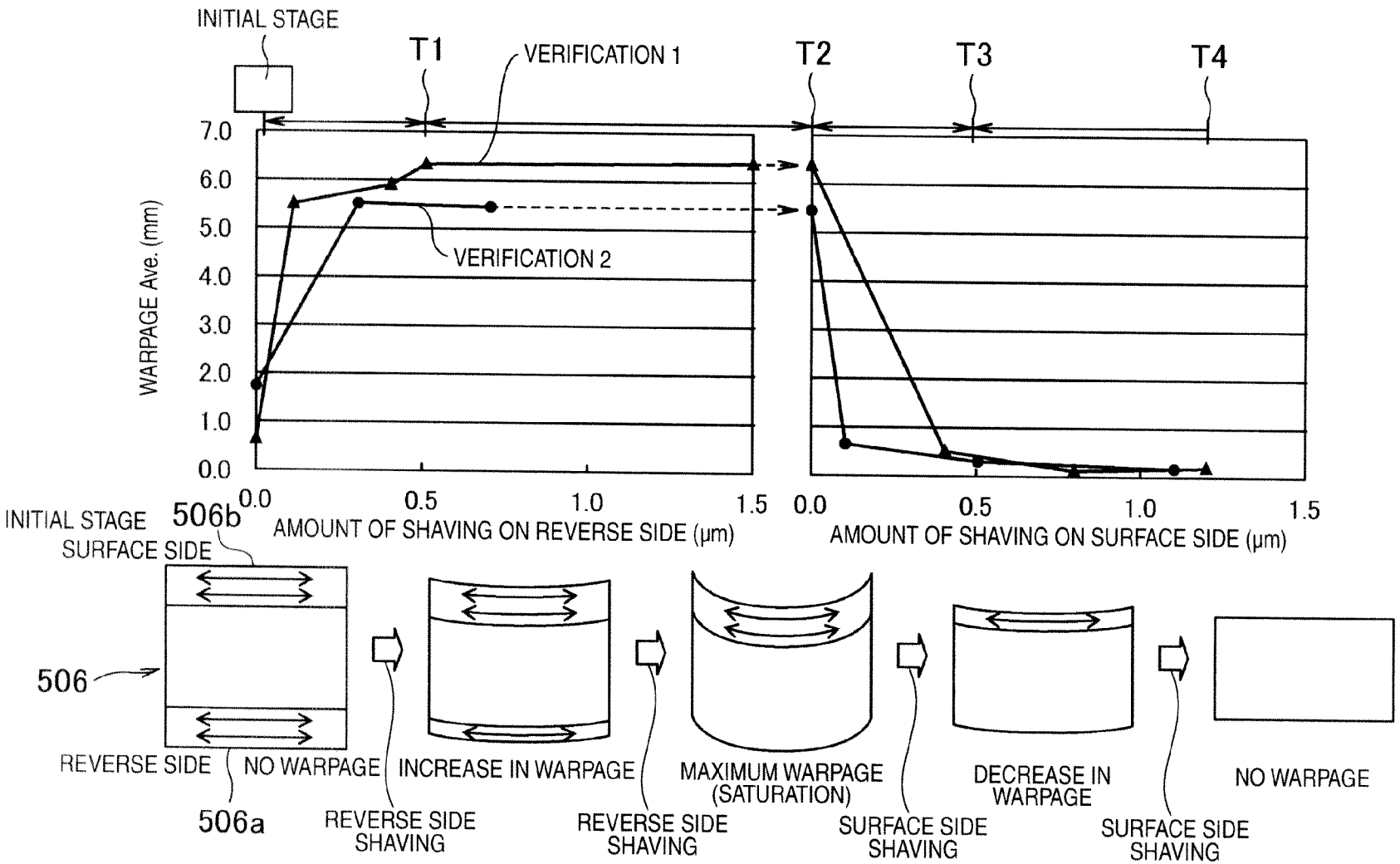
FIG. 11 is a graph and a schematic illustration showing a result of a verification test of verifying the warpage leveling effect provided by the grinding roller in the image forming apparatus PR3 of the third exemplary embodiment.

The graph of FIG. 11 shows the results of two experiments. One is the experiment of the verification 1 and the other is the experiment of the verification 2.

In the verification 1, the reverse side 506*a* was gradually shaved at the initial stage in which no warpage was generated in the side end portion 506T of the endless-belt-shaped image carrier 506 and the flaw K was formed as shown in FIGS. 1B and 1C. Due to the foregoing, at the point of time T1 from the initial stage, an amount of warpage in the upward direction was gradually increased. At the point of time T1 to T2, the amount of warpage reached the maximum value (the saturation) of 6.5 mm. At this point of time, the amount of shaving of the reverse side 506*a* was 1.5 μm.

At the timing of T2, grinding by grinding roller 200 of the surface 506*b* of the side end portion 506T of the endless-belt-shaped image carrier 506 was started. Then, at the point of time T2 to T3 (an amount of shaving: 0.5 μm), an amount of warpage was gradually decreased. At the point of time T4 (an amount of shaving: about 1.3 μm), the amount of warpage was substantially reduced to zero.

In the experiment of the verification 2, the same effect was provided when the grinding roller 200 ground the surface 506*b* of the side end portion 506T of the endless-belt-shaped image carrier 506.

Figure 12:
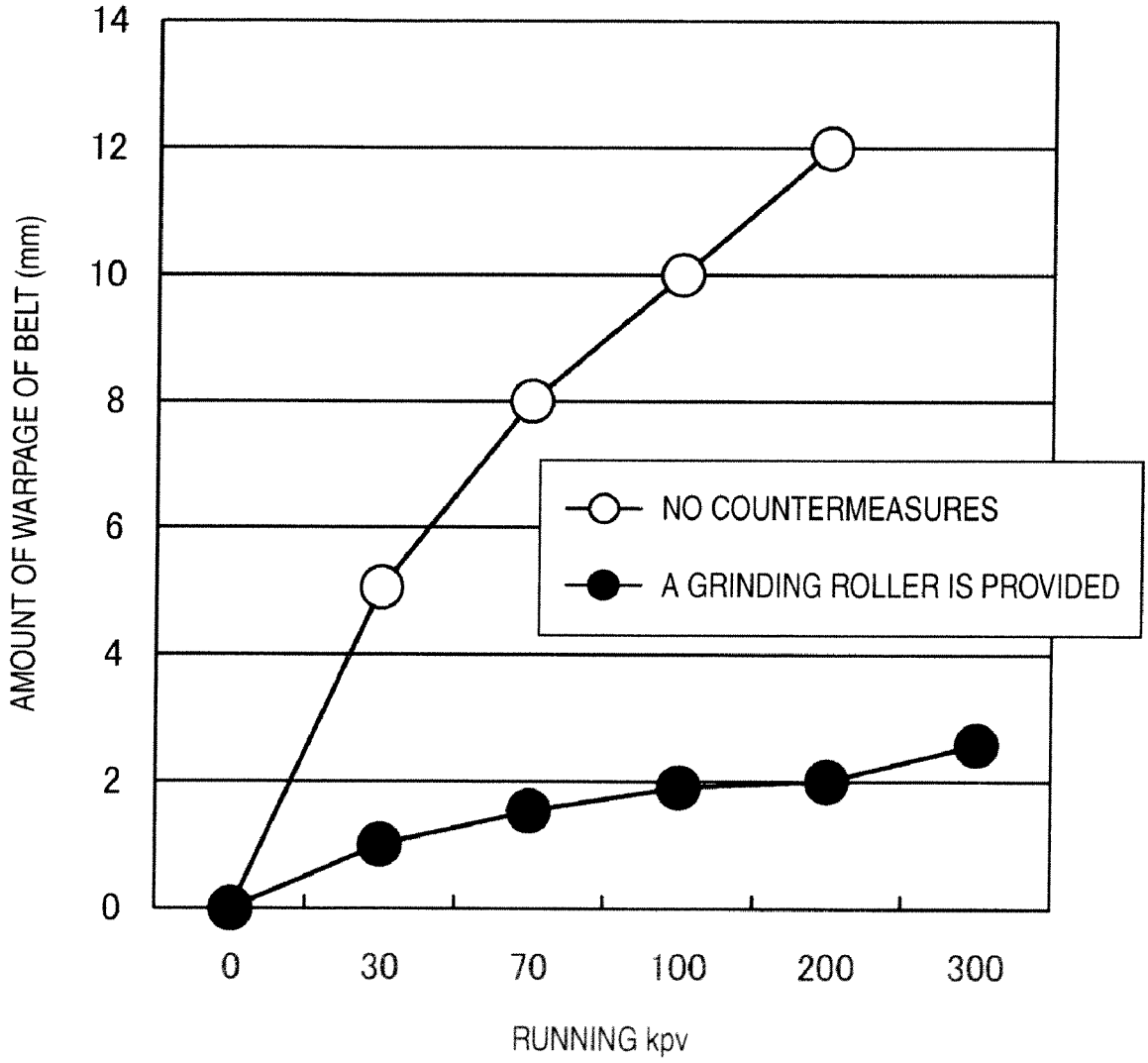
FIG. 12 is a graph showing a warpage leveling effect provided by the grinding roller in the image forming apparatus PR3 of the third exemplary embodiment.

The graph of FIG. 12 shows data in which an amount of warpage (mm) of the endless-belt-shaped image carrier 506 with respect to the number of the running sheets of paper (the running kpv) of the recording medium 115 in the printer PR3 was compared between two cases. In one case, the grinding roller 200 was provided. In the other case, the grinding roller 200 was not provided, that is, no countermeasures were taken.

Due to the foregoing, in the case where no measures were taken, an amount of warpage reached 12 mm when the number of the running sheets of paper was 200 kpv. However, in the case where the grinding roller 200 was provided, an amount of warpage was not more than 3 mm even when the number of the running sheets of paper was 300 kpv.

As described above, according to the image forming apparatus PR3 of the present exemplary embodiment, a warpage of the side end portion 506T of the endless-belt-shaped image carrier 506 can be effectively leveled.

As described in the above exemplary embodiment, the grinding roller 200, which is a form of the surface roughening member of the present exemplary embodiment, has an action of shaving the surface of the endless-belt-shaped image carrier 506.

Fourth Embodiment

Referring to FIGS. 13 to 17, explanations will be made into an image forming apparatus PR4 of the fourth exemplary embodiment of the present invention.

In this connection, concerning the constitution of the leveling tool C1 (C2) of the first exemplary embodiment, the leveling device M1 of the second exemplary embodiment and the image forming apparatus PR3 of the third exemplary embodiment, the same reference marks are used and the detailed explanations are omitted here.

A different point between the image forming apparatus PR4 of the present exemplary embodiment and the image forming apparatus PR3 of the third exemplary embodiment is that the scraper 300 (the sheet-shaped member, the tip portion of which comes into contact with the image carrier 506) is provided instead of the grinding roller 200.

Figure 13:
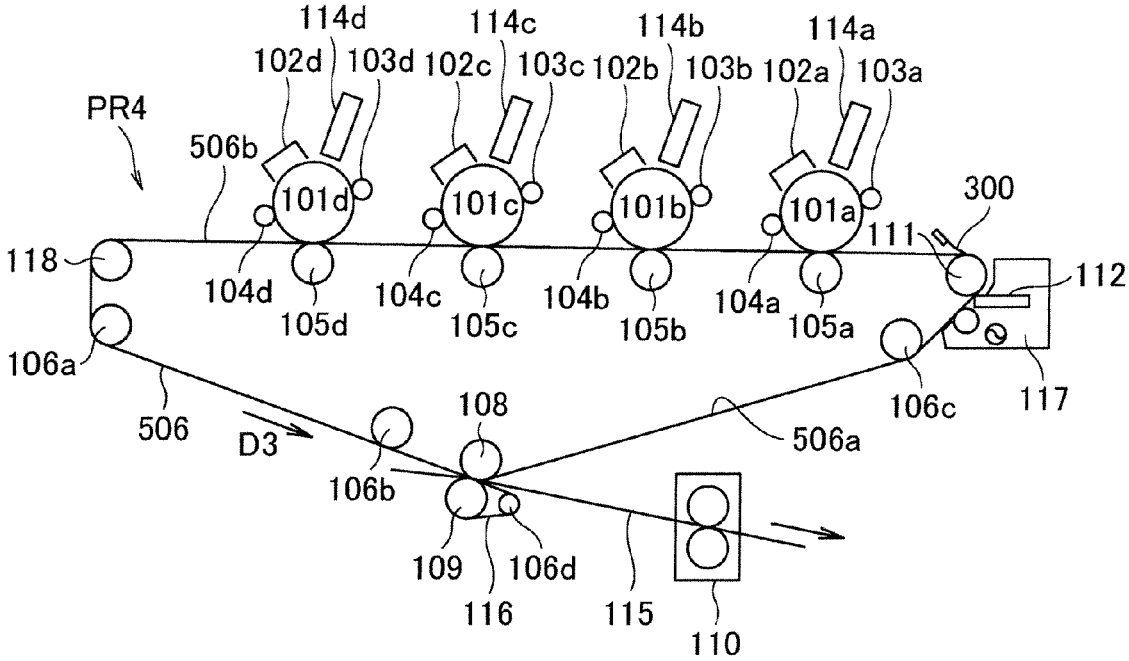
FIG. 13 is an arrangement view showing an example of the arrangement of the image forming apparatus PR4 of the fourth exemplary embodiment.
Figure 14:
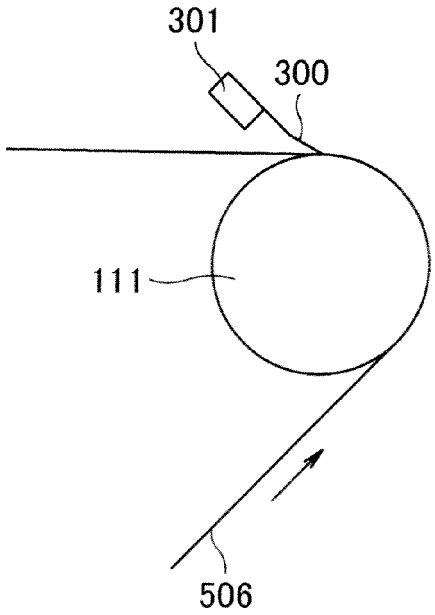
FIG. 14 is a schematic illustration showing an arrangement of the scraper in the image forming apparatus PR4 of the fourth exemplary embodiment.
Figure 15:
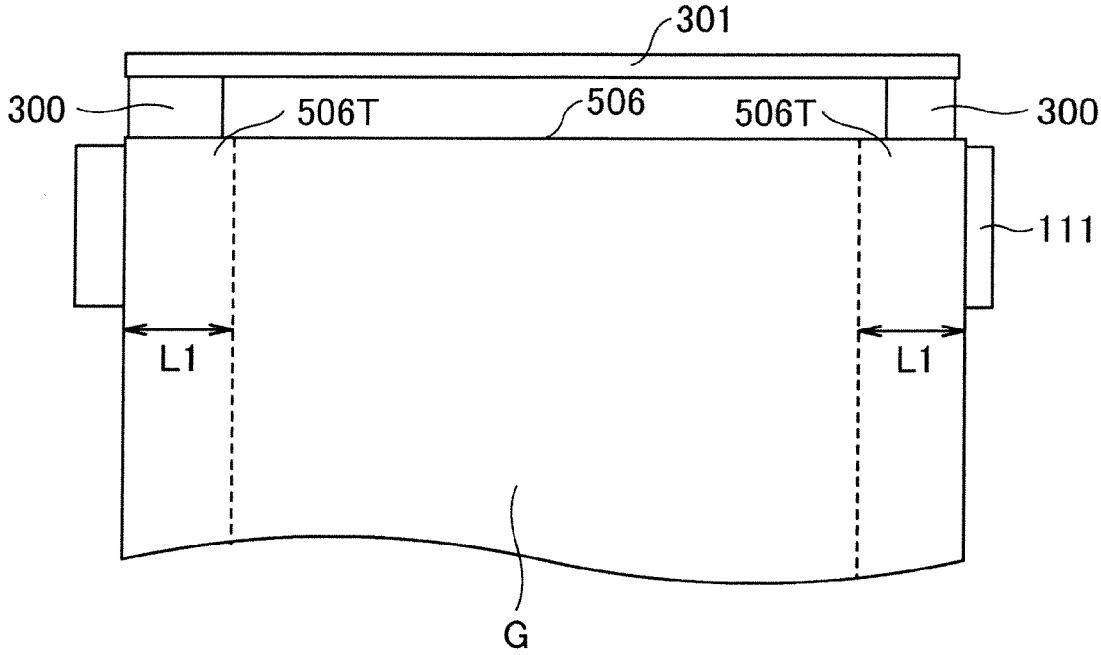
FIG. 15 is a schematic illustration showing a mounting position of mounting a scraper in the image forming apparatus PR4 of the fourth exemplary embodiment.

As shown in FIGS. 13 to 15, the scraper 300, which is a surface roughening member for roughening the surface 506*a* of the side end portion 506T of the endless-belt-shaped image carrier 506, is arranged at a position opposed to the drive roller 111 being held by a carrying member 301.

As shown in FIG. 14, a pair of scrapers 300 are provided so that the scrapers 300 can be contacted with the surfaces 506*b* of both side end portions 506T of the endless-belt-shaped image carrier 506. In this connection, the scraper 300 may be provided only on one side of the side end portion 506T.

A width of the scraper 300 is not particularly restricted. However, as explained in FIG. 5 with respect to the leveling tool C1 (C2) of the first exemplary embodiment, the width of the scraper 300 may be in the range of L1=(W1-G1)/2.

Due to the foregoing, a generation of a defective image can be prevented which is caused by an influence of the warpage generated by the flaw K (K1, K2) caused in the endless-belt-shaped image carrier 506 in the image region G.

Figure 16:
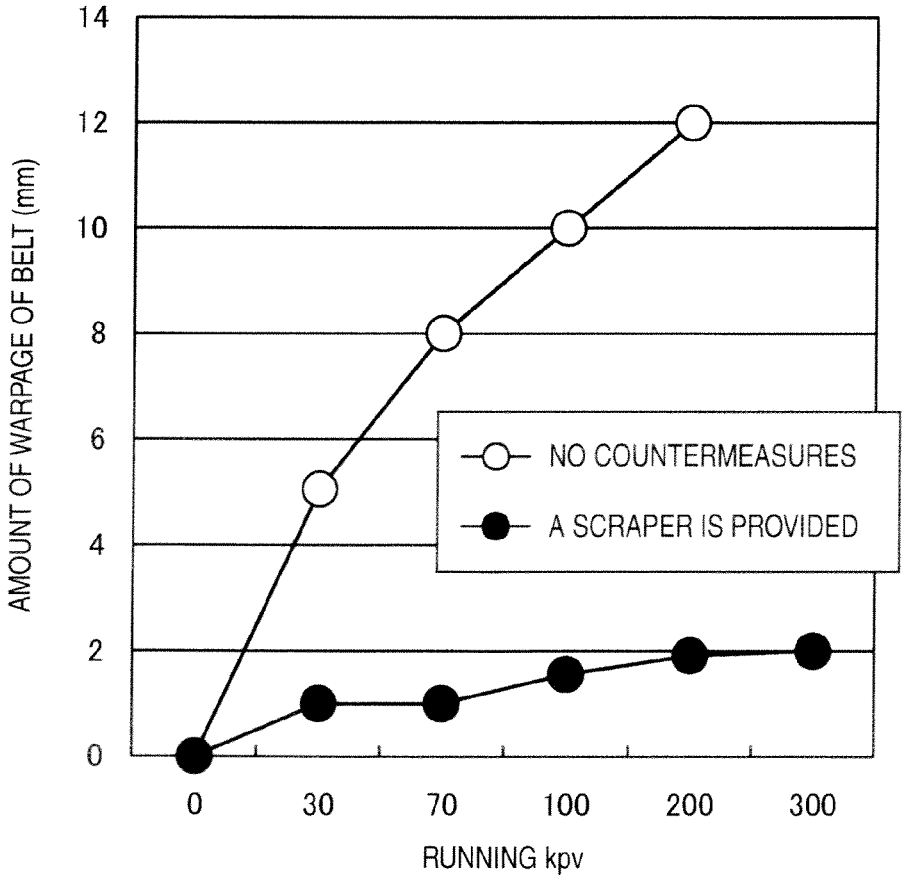
FIG. 16 is a graph showing a warpage leveling effect provided by a scraper in the image forming apparatus PR4 of the fourth exemplary embodiment.

The graph of FIG. 16 shows data of the comparison in which an amount of warpage (mm) of the endless-belt-shaped image carrier 506 with respect to the number of the running sheets of paper (the running kpv) of the recording mediums 115 in the printer PR4 is compared in two cases, wherein one is a case in which the scraper 300 is provided and the other is a case in which the scraper 300 is not provided, that is, a case in which no measures are taken.

According to the graph of FIG. 16, the following can be understood. In the case where no measures were taken, an amount of warpage reached 12 mm at the number of the running sheets of paper 200 kpv. However, in the case where the scraper 300 was provided, an amount of warpage was reduced to a value not more than 2 mm even at the number of the running sheets of paper 300 kpv.

As described above, according to the image forming apparatus PR4 of the present exemplary embodiment, a warpage of the side end portion 506T of the endless-belt-shaped image carrier 506 can be effectively leveled.

Figure 17:
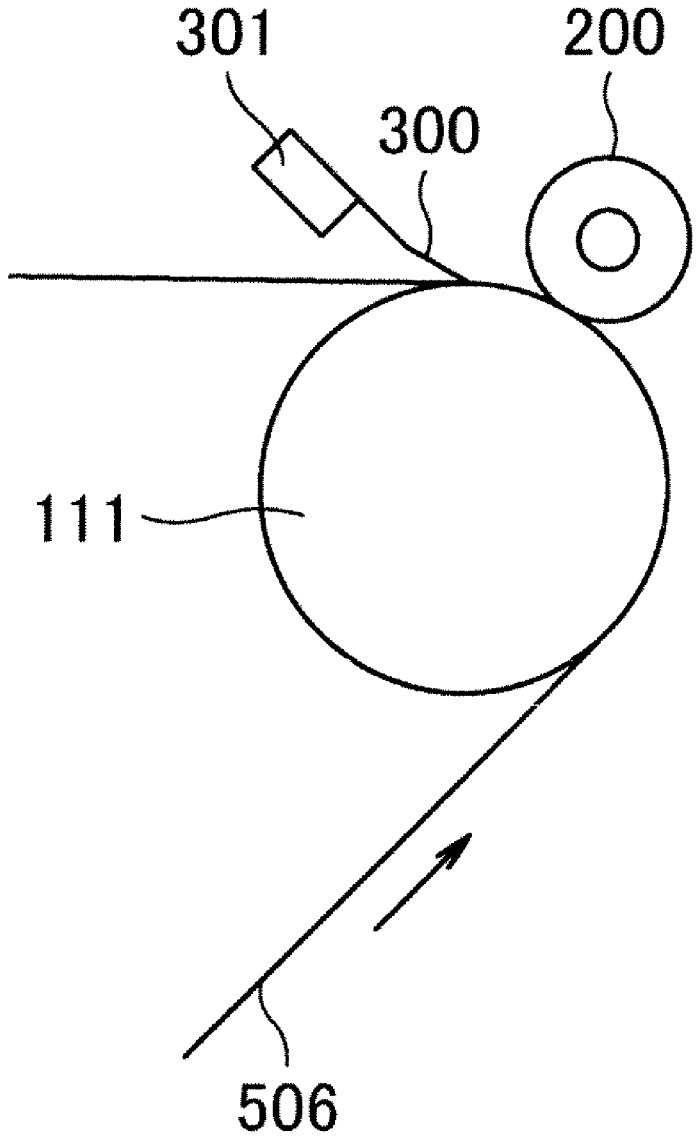
FIG. 17 is a schematic illustration showing an arrangement in which both the grinding roller and the scraper are provided.

As shown in FIG. 17, the scraper 300 may be arranged on the downstream side of the grinding roller 200 shown in the image forming apparatus PR3 of the third exemplary embodiment. Due to the foregoing, a warpage of the side end portion 506T of the endless-belt-shaped image carrier 506 can be more positively leveled.

As described above, the scraper 300, which is a form of the surface roughening member of the present exemplary embodiment, has an action of shaving the surface of the endless-belt-shaped image carrier 506.

Fifth Embodiment

Figure 18:
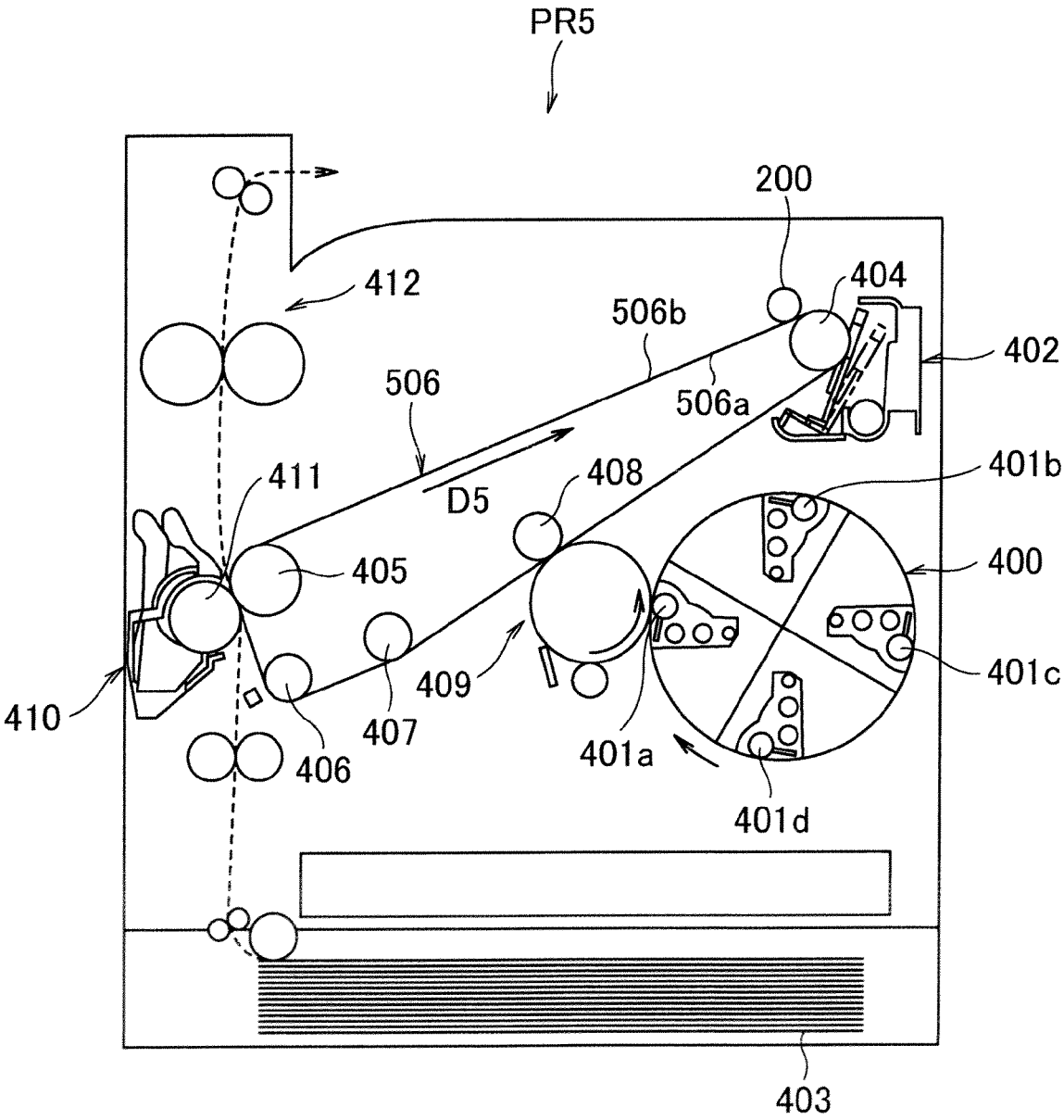
FIG. 18 is an arrangement view showing an example of the arrangement of the image forming apparatus PR5 of the fifth exemplary embodiment.
Figure 19:
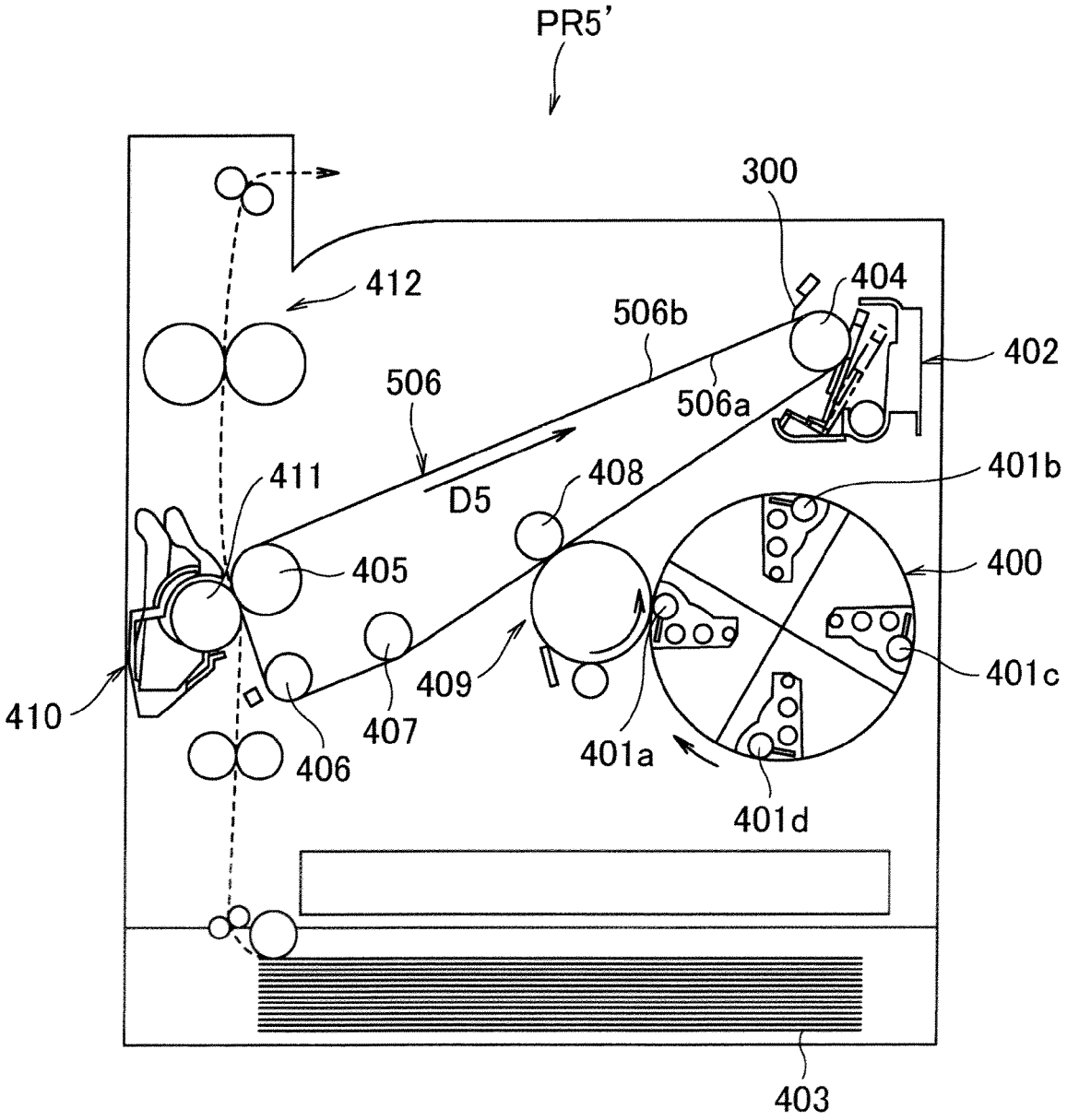
FIG. 19 is an arrangement view showing an example of the arrangement of the image forming apparatus PR5' of the fifth exemplary embodiment.

Referring to FIGS. 18 and 19, explanations will be made into an image forming apparatus PR5, PR5' of the fifth exemplary embodiment of the present invention.

In this connection, concerning the constitution of the leveling tool C1 (C2) of the first exemplary embodiment, the leveling device M1 of the second exemplary embodiment, the image forming apparatus PR3 of the third exemplary embodiment and the image forming apparatus PR4 of the fourth exemplary embodiment, the same reference marks are used and the detailed explanations are omitted here.

As shown in FIG. 18, in the rotary type printer which is the image forming apparatus PR5, the endless-belt-shaped image carrier 506 is entrained around the following rollers and rotated in the direction of the arrow D5. The rollers are: a drive roller 404 for driving the endless-belt-shaped image carrier 506; a backup roller 405; tension rollers 406, 407; and a primary transfer roller 409.

The rotary type developing unit 400 is provided which includes four developing rollers 401*a* to 401*d* coming into contact with the primary transfer roller 409.

The secondary transfer unit 410 having the secondary transfer roller 411 for secondarily transferring an image is arranged being opposed to the backup roller 405. An image is secondarily transferred onto the recording medium 403 such as a sheet of printing paper. The sheet of printing paper is heated and pressurized by the fixing unit 412 arranged in the downstream so that the image can be fixed. After that, the sheet of printing paper is discharged.

The cleaning unit 402 is arranged adjacent to the drive roller 404.

At a position opposed to the drive roller 404, the grinding roller (the rotator) 200, which is a surface roughening member for roughening the surface 506*b* of the side end portion 506T of the endless-belt-shaped image carrier 506, is pivotally arranged.

In this connection, the constitution and the function of the grinding roller 200 are the same as those of the image forming apparatus PR3 of the third exemplary embodiment explained before referring to FIGS. 10 to 12.

Due to the foregoing by an action of the grinding roller 200, a warpage of the side end portion 506T of the endless-belt-shaped image carrier 506 can be effectively leveled.

In the image forming apparatus PR5' shown in FIG. 19, the scraper 300 is arranged instead of the grinding roller 200.

In this connection, the constitution and the function of the scraper 300 are the same as those of the image forming apparatus PR4 of the fourth exemplary embodiment explained before referring to FIGS. 14 to 16.

Due to the foregoing, by an action of the scraper 300, a warpage of the side end portion 506T of the endless-belt-shaped image carrier 506 can be effectively leveled.

Sixth Embodiment

Referring to FIGS. 20 to 29, explanations will be made into an image forming apparatus PR6 to PR9 of the sixth exemplary embodiment of the present invention.

In this connection, concerning the constitution of the leveling tool C1 (C2) of the first exemplary embodiment, the leveling device M1 of the second exemplary embodiment, the image forming apparatus PR3 of the third exemplary embodiment, the image forming apparatus PR4 of the fourth exemplary embodiment and the image forming apparatus PR5 of the fifth exemplary embodiment, the same reference marks are used and the detailed explanations are omitted here.

Figure 9:
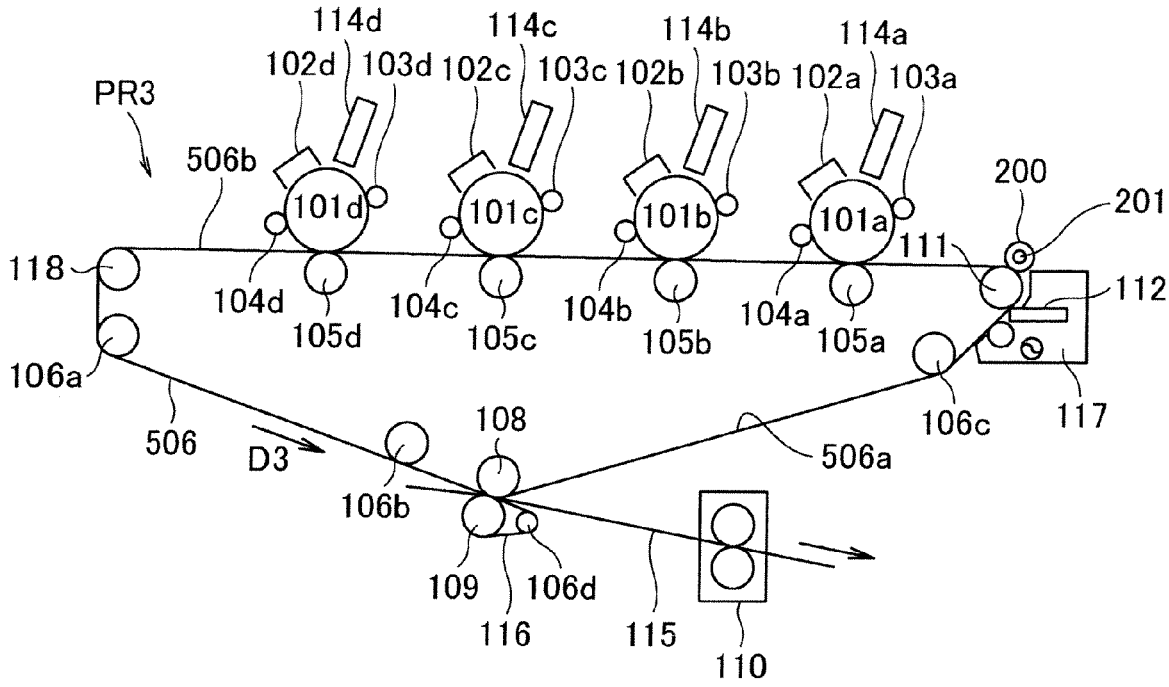
FIG. 9 is an arrangement view showing an example of the arrangement of the image forming apparatus PR3 of the third exemplary embodiment.
Figure 20:
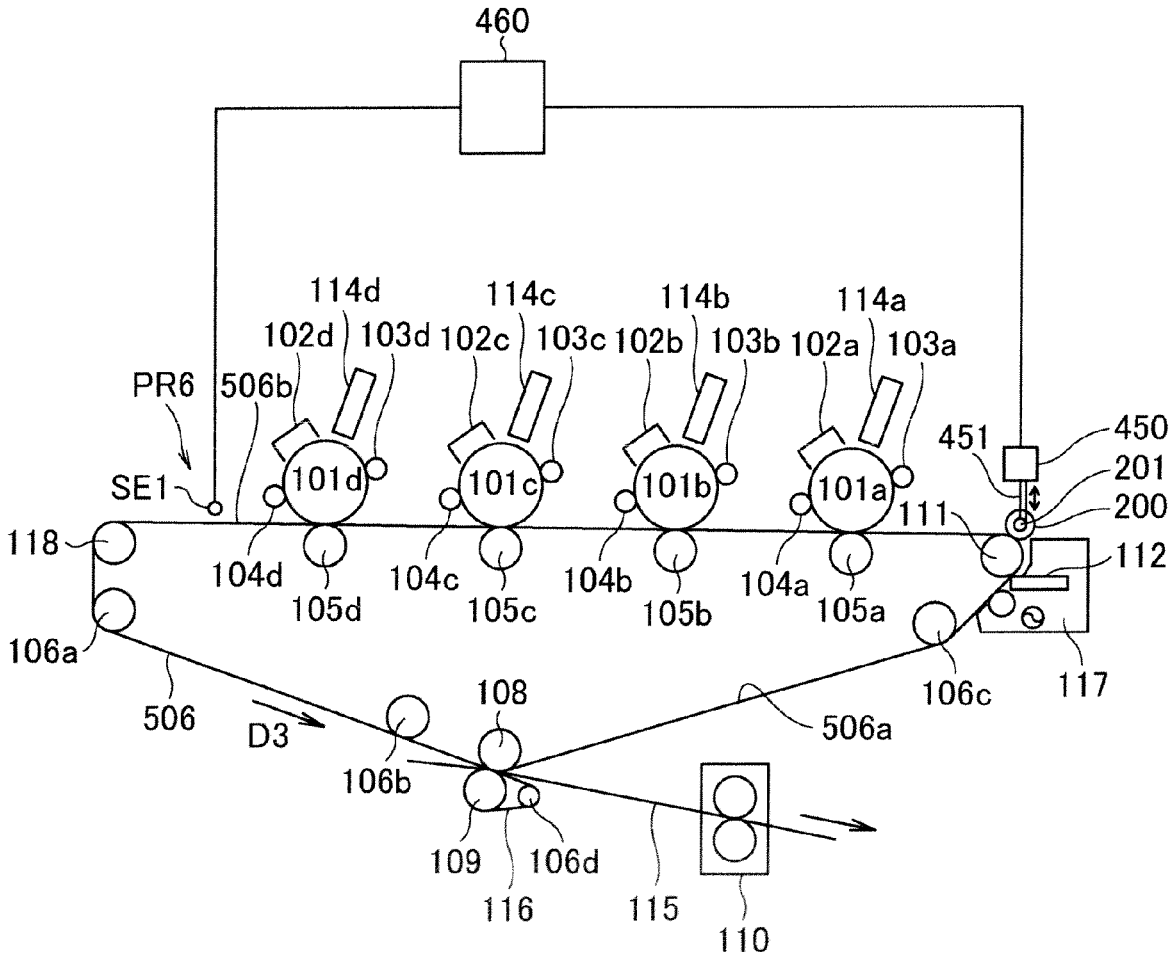
FIG. 20 is an arrangement view showing an example of the arrangement of the image forming apparatus PR6 of the sixth exemplary embodiment.
Figure 21:
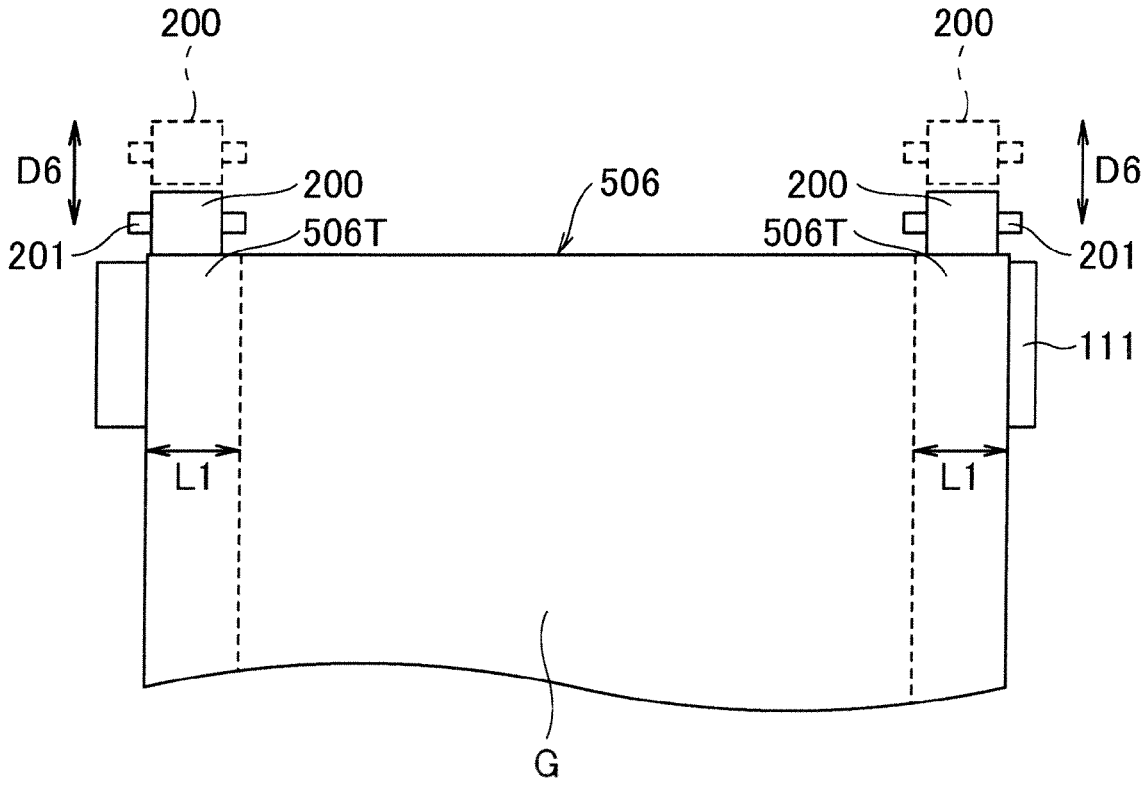
FIG. 21 is a schematic illustration showing a movement of the grinding roller in the image forming apparatus PR6 of the sixth exemplary embodiment.
Figure 22:
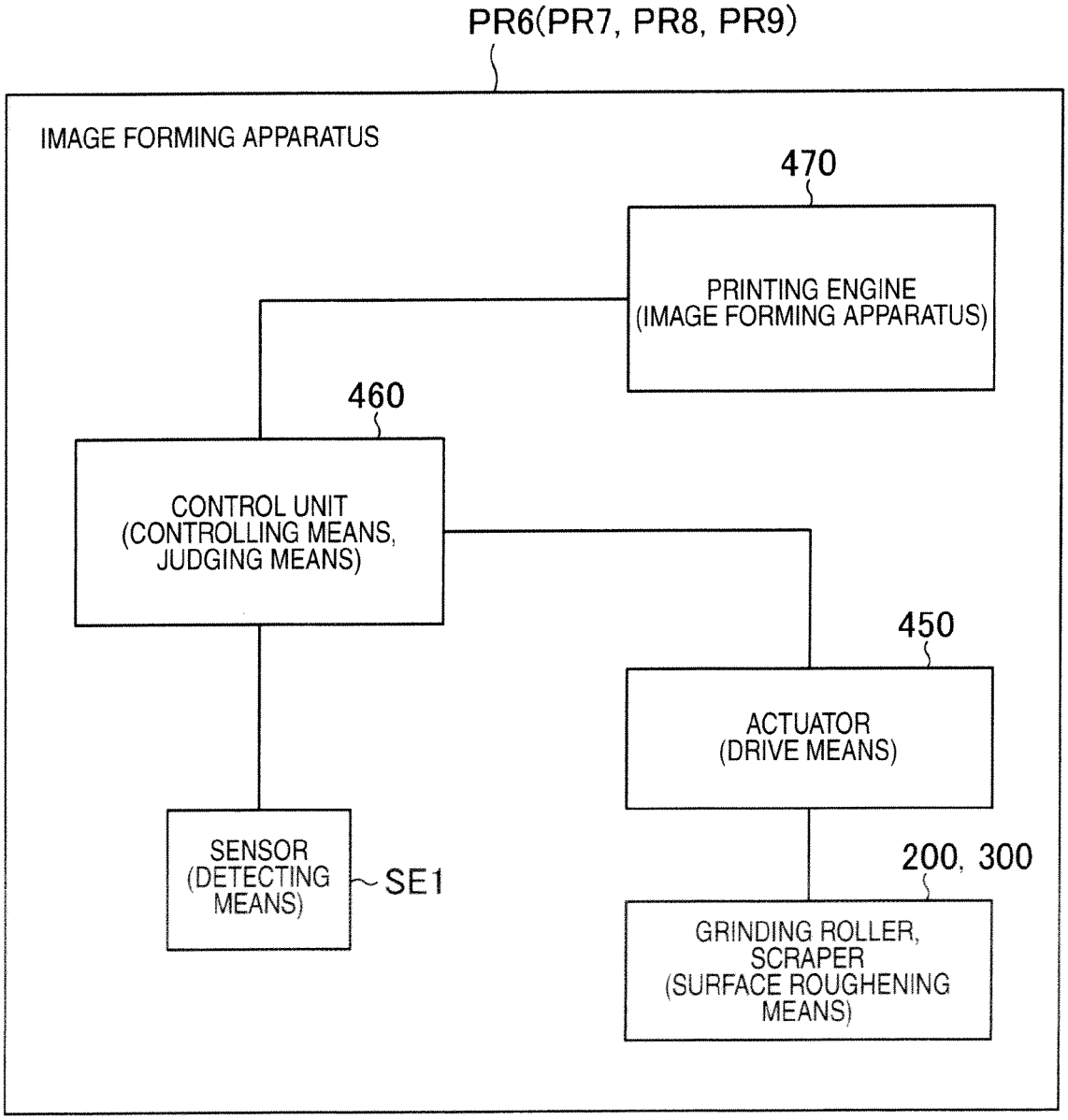
FIG. 22 is a functional block diagram showing an outline of the arrangement of the image forming apparatus PR6 of the sixth exemplary embodiment.

A different point between the image forming apparatus PR3 of the third exemplary embodiment shown in FIG. 9 and the image forming apparatus PR6 shown in FIGS. 20 to 22 is that the elevator (the driving member) 450 for elevating the grinding roller 200 in the arrowed direction D6 (shown in FIG. 21) is provided.

A drive system of the elevator 450 is not particularly restricted. For example, it is possible to use a solenoid mechanism or an air cylinder mechanism capable of protruding and retracting an operation rod 451.

In the periphery of the side end portion 506T of the endless-belt-shaped image carrier 506, the detection sensor (a detector) SE1 for detecting an amount of warpage is provided. This sensor SE1 is not particularly restricted. It is possible to use an optical sensor or a pressure sensor for the sensor SE1. In this connection, in the present exemplary embodiment, only one sensor SE1 is provided. However, two or more sensors may be provided in the periphery of the side end portion 506T of the endless-belt-shaped image carrier 506.

The control unit 460 is provided which includes a microcomputer for processing a detection signal sent from the sensor SE1 and driving the elevator 450 at a predetermined timing.

In this connection, the control unit 460 is also connected to the printing engine (a image forming unit) and conducts an image forming processing on a predetermined recording medium.

Due to the foregoing, an amount of warpage of the side end portion 506T of the endless-belt-shaped image carrier 506 is detected by the sensor SE1. In the case where it is judged in the operation processing executed by the control unit 460 that the amount of warpage exceeds a predetermined threshold value, the elevator 450 is driven.

When the operation rod 451 is lowered being driven by the elevator 450, the grinding roller 200 comes into contact with the surface 506*b* of the side end portion 506T of the endless-belt-shaped image carrier 506 and the surface is roughened. In this way, the warpage of the side end portion 506T of the endless-belt-shaped image carrier 506 is leveled.

As described above, according to the image forming apparatus PR6 of the present exemplary embodiment, the grinding roller 200 can be operated at a desired timing at which a warpage of the side end portion 506T of the endless-belt-shaped image carrier 506 is to be leveled and it is possible to effectively prevent interference of the side end portion 506T of the endless-belt-shaped image carrier 506 with other members. Therefore, the convenience of using the apparatus can be enhanced.

Figure 23:
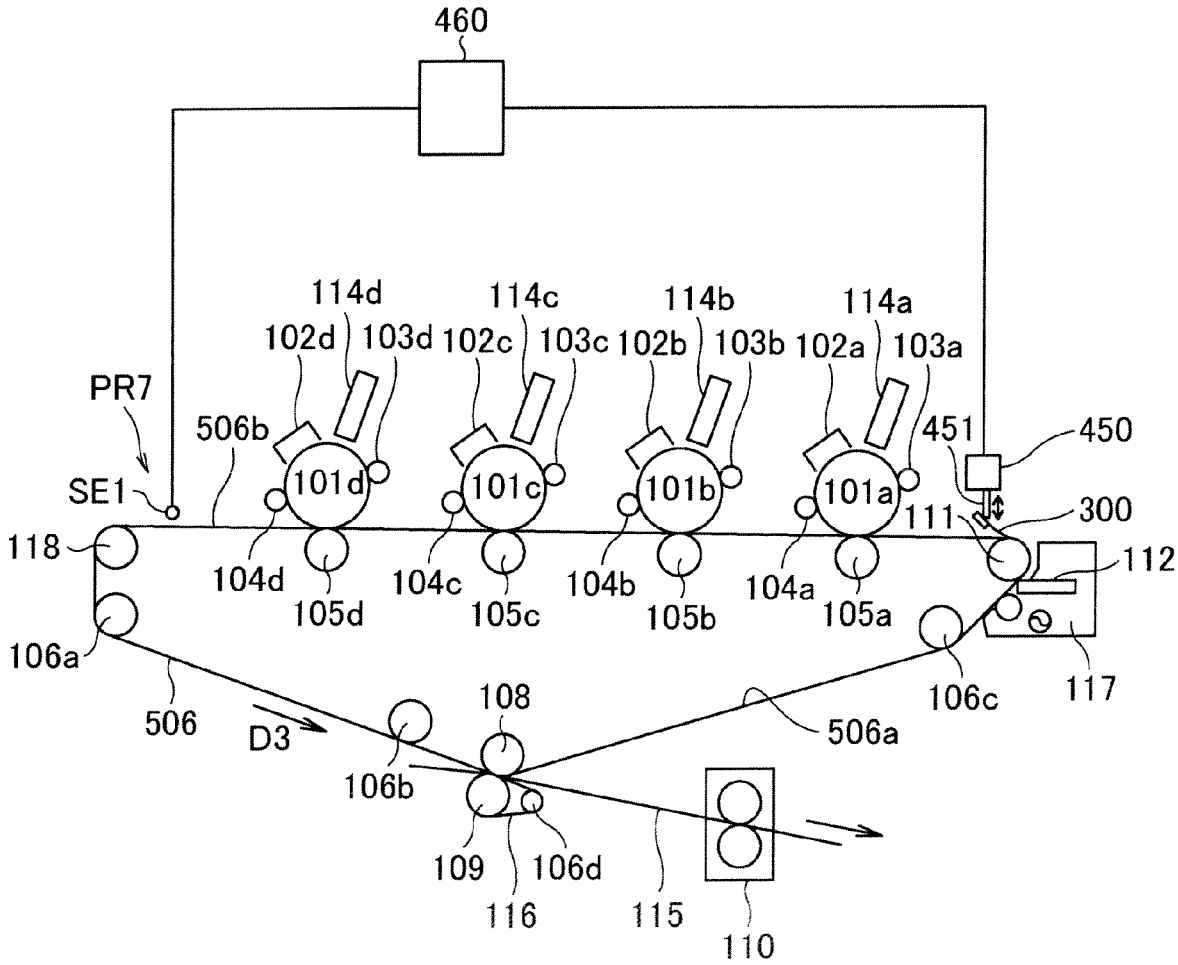
FIG. 23 is an arrangement view showing an example of the arrangement of the image forming apparatus PR7 of the sixth exemplary embodiment.
Figure 24:
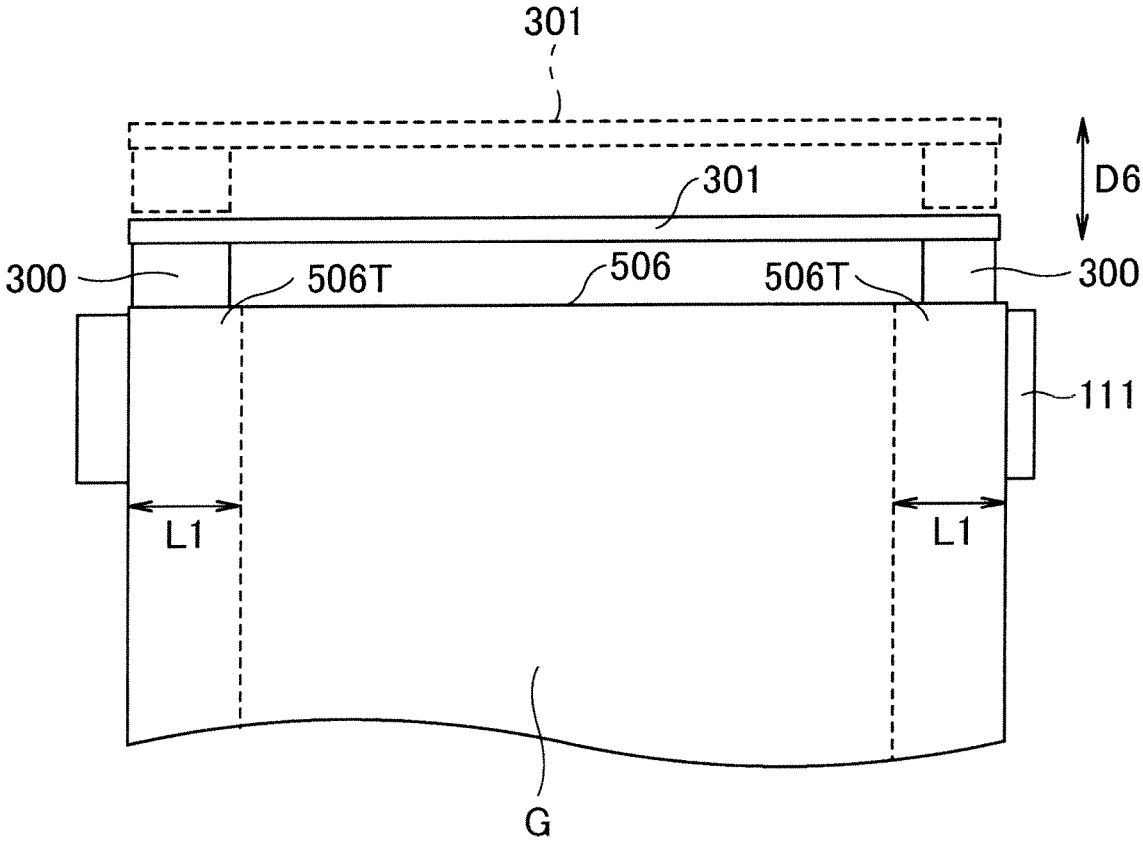
FIG. 24 is a schematic illustration showing a movement of the scraper in the image forming apparatus PR7 of the sixth exemplary embodiment.

Next, referring to FIGS. 23 and 24, the image forming apparatus PR7 will be described below.

A different point between the image forming apparatuses PR7 and PR8 is described as follows. Instead of the grinding roller 200, the scraper 300 is elevated in the arrowed direction D6 by the elevator 450.

Due to the foregoing, the scraper 300 can be contacted at a desired timing at which a warpage of the side end portion 506T of the endless-belt-shaped image carrier 506 is to be leveled and it is possible to effectively prevent interference of the side end portion 506T of the endless-belt-shaped image carrier 506 with other members. Therefore, the convenience of using the apparatus can be enhanced.

Figure 25:
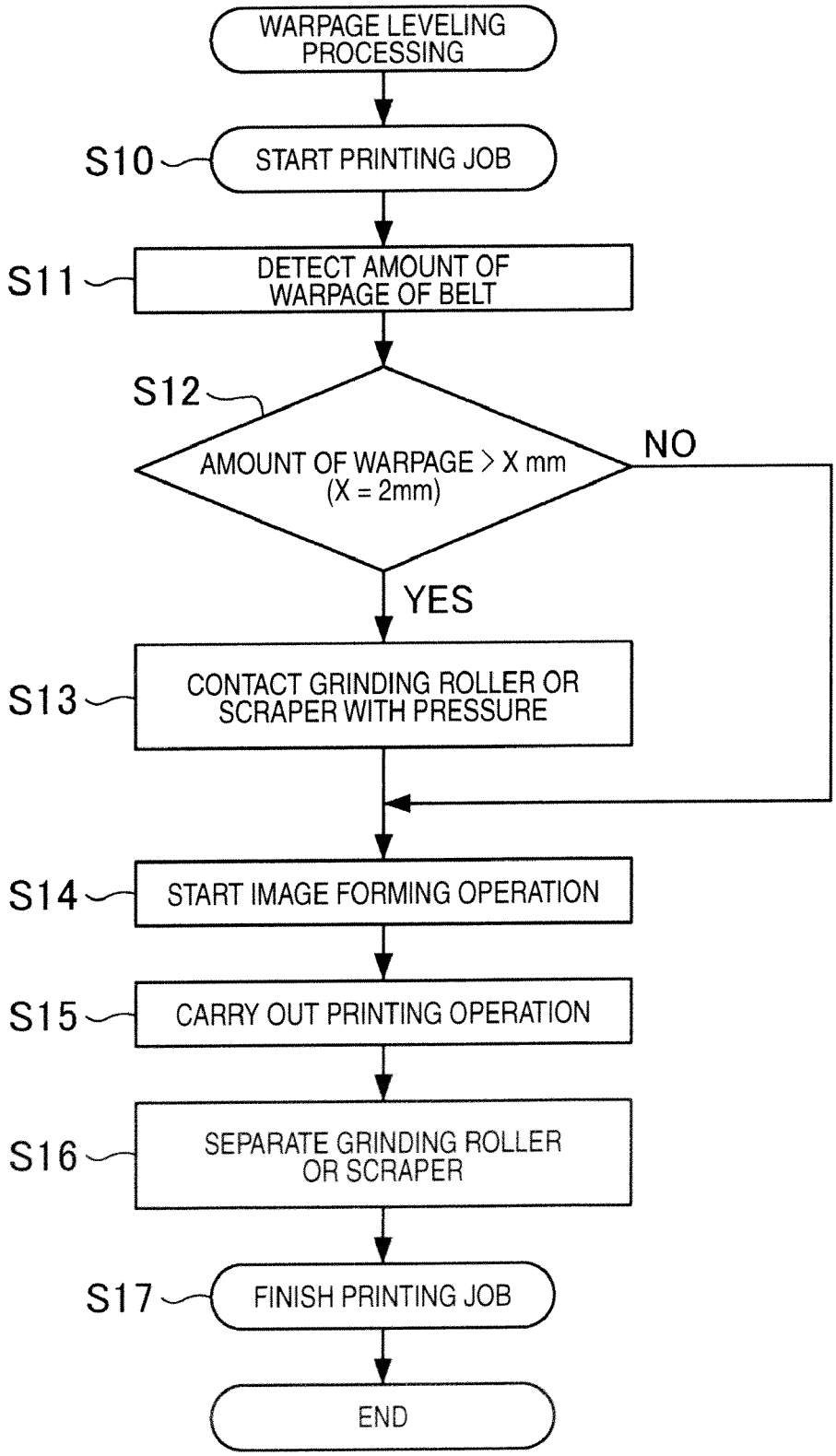
FIG. 25 is a flow chart showing a processing procedure of warpage leveling processing in the image forming apparatus PR6 or PR7 of the sixth exemplary embodiment.

In this case, referring to the flow chart of FIG. 25, explanations will be made into a processing procedure of the warpage leveling processing carried out by the control unit 460 of the image forming apparatus PR6 or PR7.

First of all, in step S10, the printing job is started by the printing engine 470. In step S11, an amount of warpage of the belt is detected by the sensor SE1. Then, the program is transferred to step S12.

In step S12, it is judged whether or not (the amount of warpage)>X mm. In this case, X is a predetermined threshold value. In the present exemplary embodiment, X=2 mm.

In the case where the judgment result is "No", the program is transferred to step S14. In the case where the judgment result is "Yes", the program is transferred to step S13 and elevator 450 is driven and the grinding roller 200 or the scraper 300 is made to come into pressure contact with the surface 506*b* of the side end portion 506T of the endless-belt-shaped image carrier 506. Then, the program is transferred to step S14.

Due to the foregoing, the grinding roller 200 or the scraper 300 can be operated at a desired timing (The timing can be adjusted by the setting of the threshold value X.) at which a warpage of the side end portion 506T of the endless-belt-shaped image carrier 506 is to be leveled and it is possible to effectively prevent interference of the side end portion 506T of the endless-belt-shaped image carrier 506 with other members at the time of the maintenance work in which the endless-belt-shaped image carrier 506 is replaced.

Next, in step S14, an image forming action is started by the printing engine 470. In step S15, printing is executed on a recording medium such as a sheet of printing paper. After that, the program is transferred to step S16.

In step S16, the elevator 450 is driven so as to separate the grinding roller 200 or the scraper 300 from the surface 506*b* of the side end portion 506T of the endless-belt-shaped image carrier 506. In step S17, the printing job is finished and the warpage leveling processing is completed.

In this connection, instead of the sensor SE1 or in addition to the sensor SE1, a drive switch for the elevator 450 may be provided and a maintenance worker may manually operate the drive switch so as to appropriately level a warpage.

Instead of the sensor SE1 or in addition to the sensor SE1, a sensor (for example, a limit switch) for detecting a movement of the endless-belt-shaped image carrier 506 in the axial direction at the time of the maintenance work may be provided and a warpage may be leveled when the elevator 450 is driven according to a detection signal sent from this sensor. Due to the foregoing, at the time of the maintenance work, the interference of the side end portion 506T of the endless-belt-shaped image carrier 506 with other members can be automatically avoided.

Figure 26:
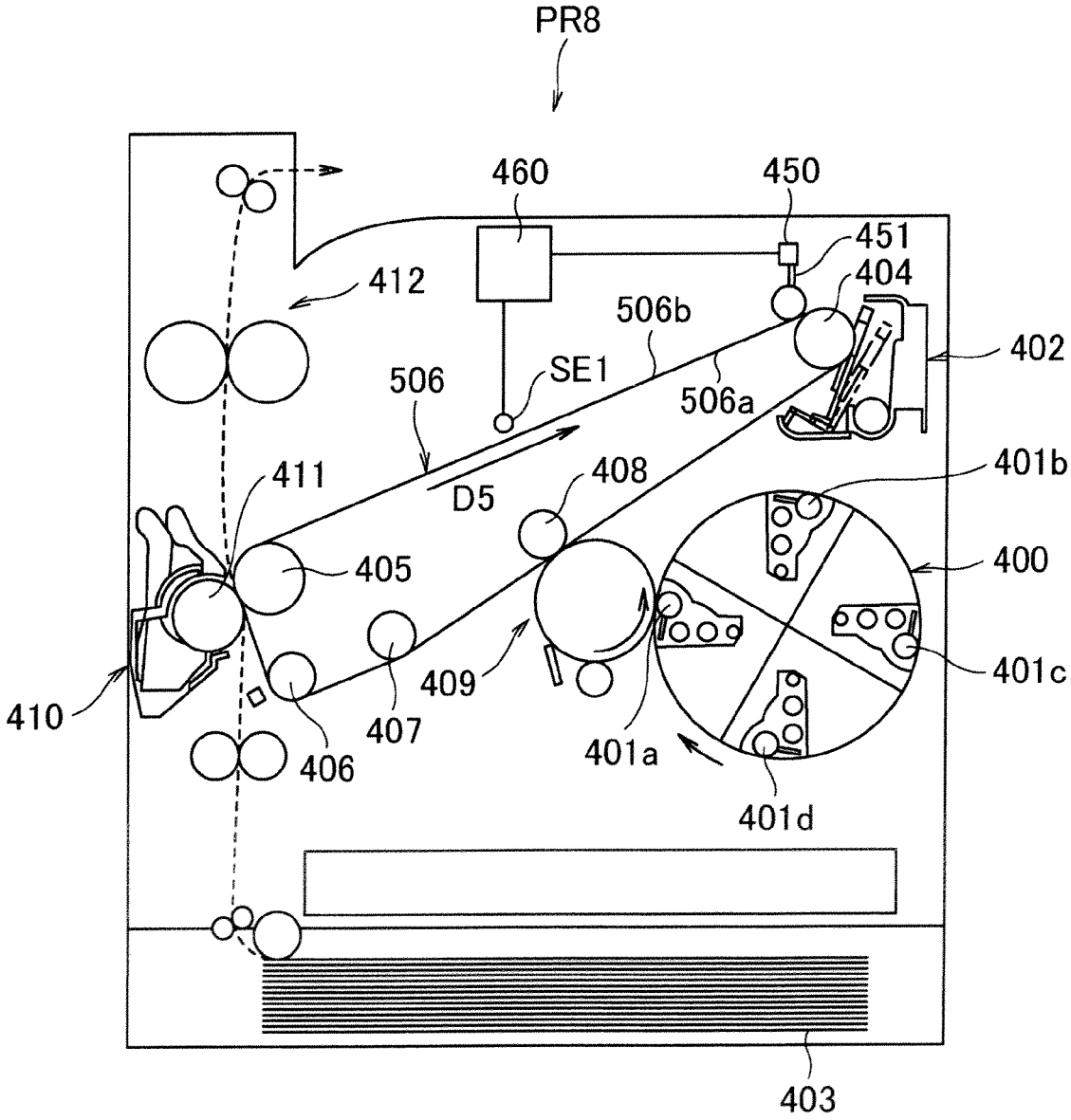
FIG. 26 is an arrangement view showing an example of the arrangement of the image forming apparatus PR8 of the sixth exemplary embodiment.

Next, referring to FIG. 26, the image forming apparatus PR8 will be described below.

A different point between the image forming apparatus PR3 of the fifth exemplary embodiment shown in FIG. 18 and the image forming apparatus PR8 is that the elevator (the driving member) 450 for elevating the grinding roller 200 in the arrowed direction D6 shown in FIG. 21 is provided.

Due to the foregoing, an amount of warpage of the side end portion 506T of the endless-belt-shaped image carrier 506 is detected by the sensor SE1. In the case where it is judged by the operation processing executed by the control unit 470 that the amount of warpage has exceeded a predetermined threshold value, the elevator 450 is driven.

Figure 27:
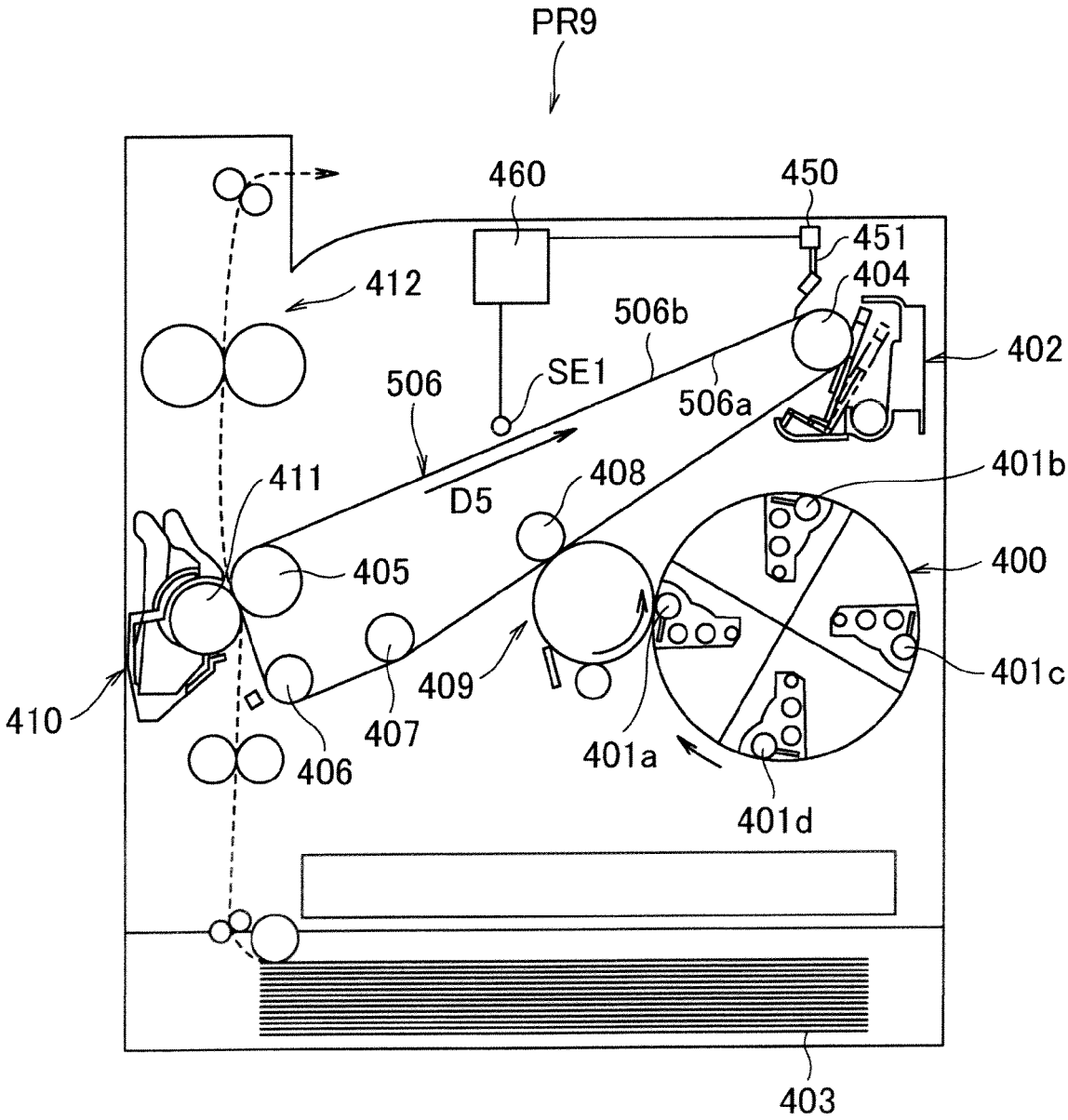
FIG. 27 is an arrangement view showing an example of the arrangement of the image forming apparatus PR9 of the sixth exemplary embodiment.

Next, referring to FIG. 27, the image forming apparatus PR9 will be described below.

A different point between the image forming apparatuses PR8 and PR9 is that instead of the grinding roller 200 the scraper 300 is elevated by the elevator 450.

Due to the foregoing, the scraper 300 can be contacted at a desired timing at which a warpage of the side end portion 506T of the endless-belt-shaped image carrier 506 is to be leveled and it is possible to effectively prevent interference of the side end portion 506T of the endless-belt-shaped image carrier 506 with other members. Therefore the convenience of using the apparatus can be enhanced.

Figure 28:
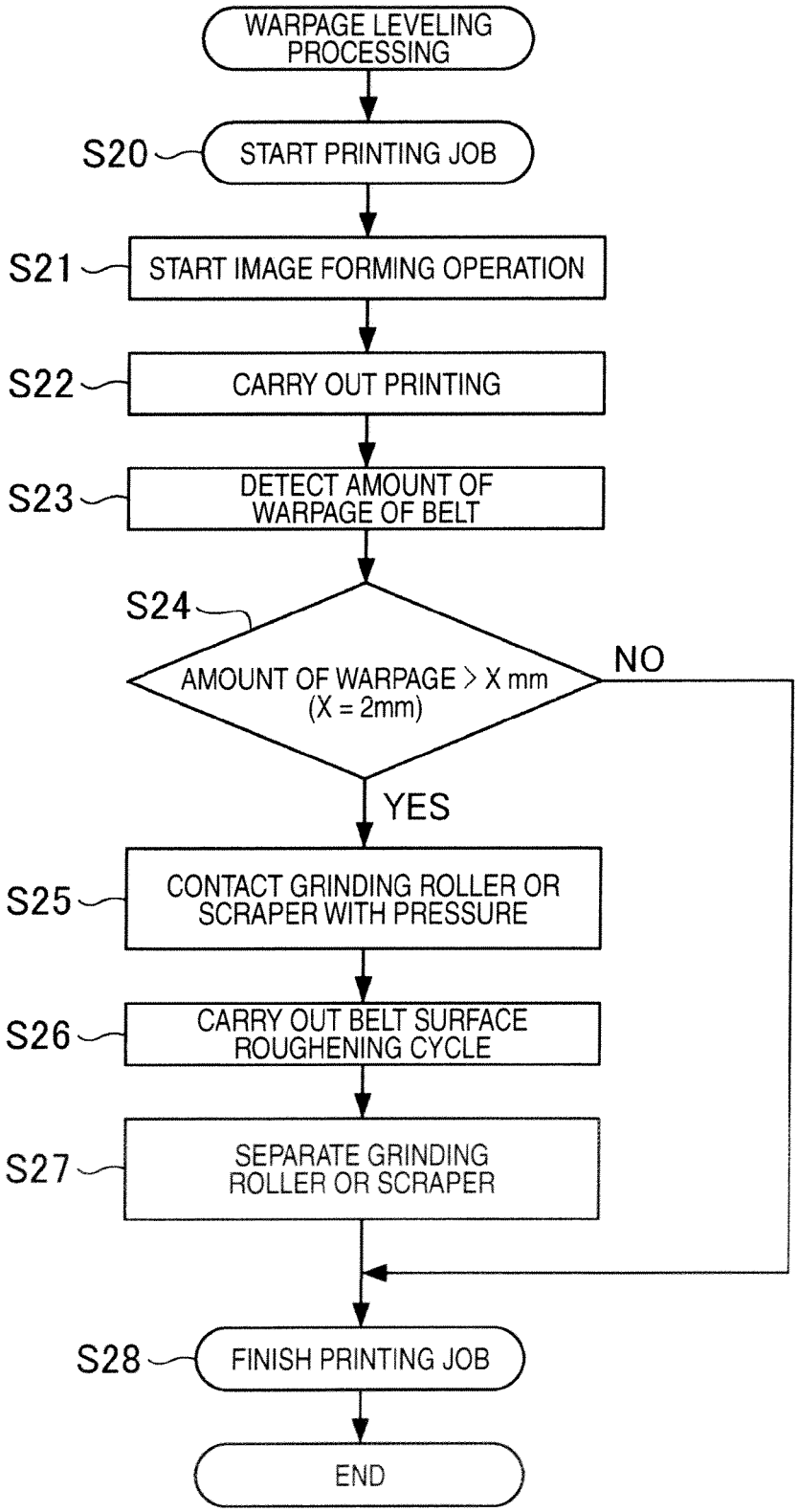
FIG. 28 is a flow chart showing a processing procedure of warpage leveling processing in the image forming apparatus PR8 or PR9 of the sixth exemplary embodiment.

In this case, referring to the flow chart of FIG. 28, explanations will be made into a processing procedure of the warpage leveling processing carried out by the control unit 460 of the image forming apparatus PR8 or PR9.

First of all, in step S20, the printing job is started by the printing engine 470. In step S21, an image forming action is started. In step S22, printing is carried out on a recording medium such as a printing sheet of paper. Then, the program is transferred to step S23.

In step S23, an amount of warpage of the belt is detected by the sensor SE1. Then, the program is transferred to step S24.

In step S24, it is judged whether or not (the amount of warpage)>X mm. In this case, X is a predetermined threshold value. In the present exemplary embodiment, X=2 mm.

In the case where the judgment result is "No", the program is transferred to step S28. In the case where the judgment result is "Yes", the program is transferred to step S25 and the elevator 450 is driven and the grinding roller 200 or the scraper 300 is made to come into pressure contact with the surface 506*b* of the side end portion 506T of the endless-belt-shaped image carrier 506. Then, the program is transferred to step S26.

In step S26, the belt surface roughening cycle is carried out and then the program is transferred to step S27. In this case, the belt surface roughening cycle is defined as the following processing. For example, a pressure contact state of the grinding roller 200 or the scraper 300 with the surface 506*b* of the side end portion 506T of the endless-belt-shaped image carrier 506 is maintained over a predetermined period of time. Alternatively, a rotating speed of the grinding roller 200 is controlled.

Due to the foregoing, the grinding roller 200 or the scraper 300 can be operated at a desired timing (The timing can be adjusted by the setting of the threshold value X.) at which a warpage of the side end portion 506T of the endless-belt-shaped image carrier 506 is to be leveled and it is possible to effectively prevent interference of the side end portion 506T of the endless-belt-shaped image carrier 506 with other members at the time of the maintenance work in which the endless-belt-shaped image carrier 506 is replaced.

In step S27, the elevator 450 is driven so as to separate the grinding roller 200 or the scraper 300 from the surface 506*b* of the side end portion 506T of the endless-belt-shaped image carrier 506. In step S28, the printing job is finished and the warpage leveling processing is completed.

In this connection, instead of the sensor SE1 or in addition to the sensor SE1, a drive switch for the elevator 450 may be provided and a maintenance worker may manually operate the drive switch so as to appropriately level a warpage.

Instead of the sensor SE1 or in addition to the sensor SE1, a sensor (for example, a limit switch) for detecting a movement of the endless-belt-shaped image carrier 506 in the axial direction at the time of the maintenance work may be provided and a warpage may be leveled when the elevator 450 is driven according to a detection signal sent from this sensor.

Due to the foregoing, at the time of the maintenance work, the interference of the side end portion 506T of the endless-belt-shaped image carrier 506 with other members can be automatically avoided.

Figure 29:
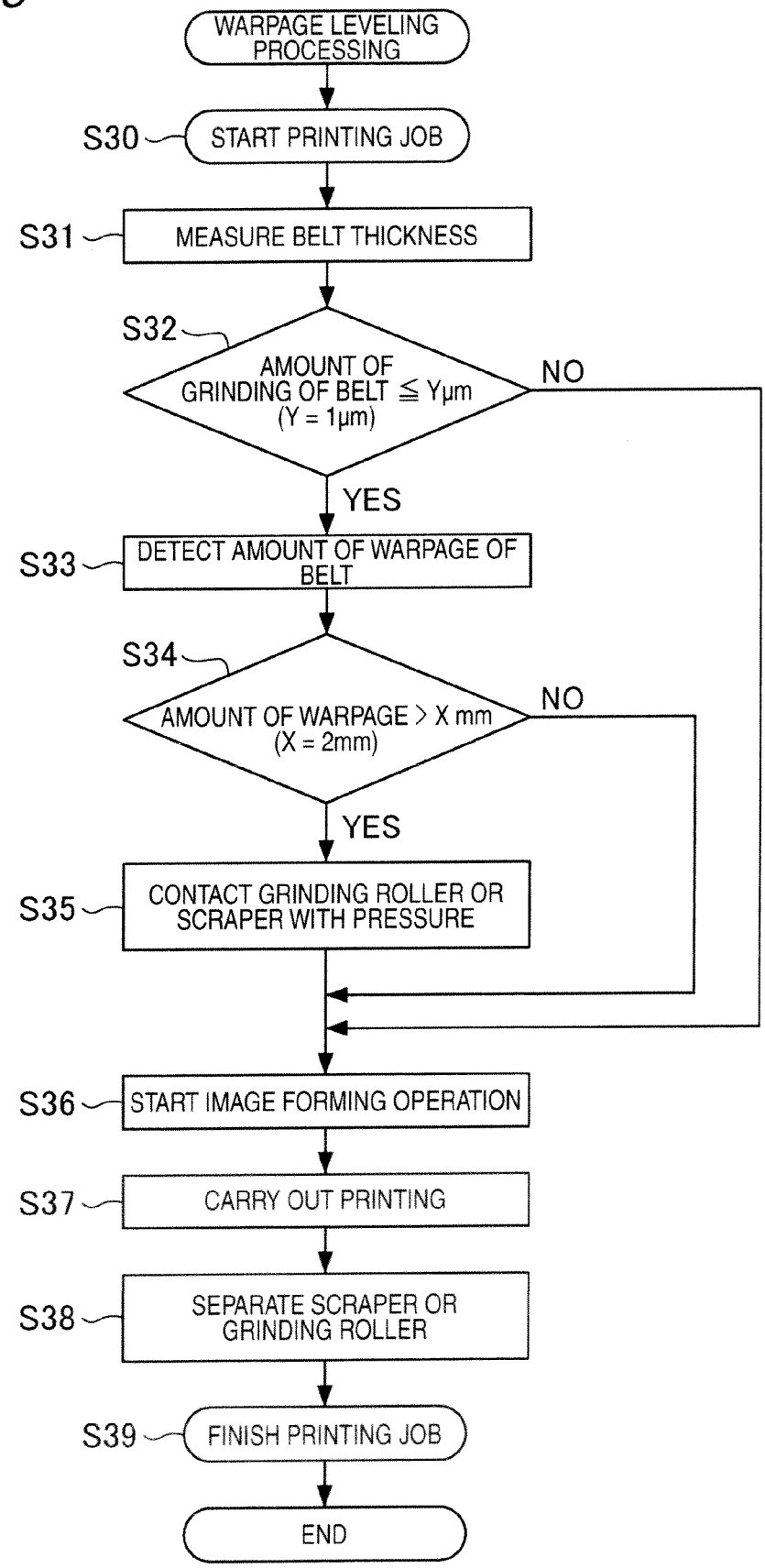
FIG. 29 is a flow chart showing another processing procedure of warpage leveling processing.

Next, referring to the flow chart of FIG. 29, another processing procedure of the warpage leveling processing carried out by the control unit 460 will be explained below.

First, in step S30, the printing job is started by the printing engine 470. In step S31 the belt thickness is measured.

For example, when the belt thickness is measured every predetermined time, it is possible to calculate an amount of grinding of the belt.

The measuring method is not particularly restricted. The measurement can be made in such a manner that a sensor or a measurement device for detecting the belt thickness is provided in the periphery of the side end portion 506T of the endless-belt-shaped image carrier 506 and the belt thickness is measured with the device.

Next, in step S32, it is judged whether or not (Amount of grinding of belt)≦Y μm. In this case. Y is a predetermined threshold value. In the present exemplary embodiment, Y=1 μm.

In the case where the judgment result is "No", the program is transferred to step S36. In the case where the judgment result is "Yes", the program is transferred to step S33.

In step S33, an amount of warpage of the belt is measured by the sensor SE1 and the program is transferred to step S34.

In step S34, it is judged whether or not (Amount of warpage)>X mm. In this case, X is a predetermined threshold value. In the present exemplary embodiment, X=2 mm.

In the case where the judgment result is "No", the program is transferred to step S36. In the case where the judgment result is "Yes", the program is transferred to step S35 and the elevator 450 is driven and the grinding roller 200 or the scraper 300 is made to come into pressure contact with the surface 506*b* of the side end portion 506T of the endless-belt-shaped image carrier 506. After that, the program is transferred to step S36.

Due to the foregoing, the grinding roller 200 or the scraper 300 can be operated at a desired timing (The timing can be adjusted by the setting of the threshold values Y and X.) at which a warpage of the side end portion 506T of the endless-belt-shaped image carrier 506 is to be leveled and it is possible to effectively prevent interference of the side end portion 506T of the endless-belt-shaped image carrier 506 with other members at the time of the maintenance work in which the endless-belt-shaped image carrier 506 is replaced.

Next, in step S36, an image forming action is started by the printing engine 470. In step S37, printing is executed on the recording medium such as a sheet of printing paper. After that, the program is transferred to step S38.

In step S38, the elevator 450 is driven so as to separate the grinding roller 200 or the scraper 300 from the surface 506*b* of the side end portion 506T of the endless-belt-shaped image carrier 506. In step S39, the printing job is finished and the warpage leveling processing is completed.

The invention accomplished by the present inventors has been specifically explained above referring to the exemplary embodiments. However, all exemplary embodiments disclosed in this specification are exemplarily shown here. Therefore, it should be noted that the present invention is not restricted by the disclosed technique. That is, the scope of the technique of the present invention is not restricted by the specific examples and the present invention should be construed by the scope of claim of the present invention. The present invention includes the technique equivalent to the technique described in the scope of claim of the present invention. Further, the present invention includes all variations without departing from the scope of claim of the present invention.

In the case where programs are used, it is possible to provide the programs through a network. Alternatively, it is possible to provide the programs accommodated in the recording mediums such as CD-ROM.

The warpage leveling unit, the warpage leveling device, the image forming apparatus and the warpage leveling program of the present invention can be applied to the laser printer, the full color printer, the compound machine, the facsimile terminal equipment and so forth.

What is claimed is:

1. A warpage leveling unit comprising:

a surface roughening member that is provided to oppose to a side end portion of an image carrier which has an endless-belt-shape, is entrained around a plurality of rollers, and carries an image on a surface thereof, wherein the surface roughening member comes into contact with a surface of the side end portion which is warped, wherein the surface roughening member includes one of a plate with a tip portion or a needle that comes into contact with the surface of the side end portion of the image carrier.

2. The warpage leveling unit according to claim 1, wherein the surface roughening member forms a groove on a surface of the side end portion of the image carrier.

* * * * *